US006042213A

United States Patent [19]

Hayasaki

[11] Patent Number: 6,042,213

[45] **Date of Patent: *Mar. 28, 2000**

[54] METHOD AND APPARATUS FOR CORRECTING PRINTHEAD, PRINTHEAD CORRECTED BY THIS APPARATUS, AND PRINTING APPARATUS USING THIS PRINTHEAD

[75] Inventor: Kimiyuki Hayasaki, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/545,463

[22] Filed: Oct. 19, 1995

[30] Foreign Application Priority Data

Oct. 28, 1994 [JP] Japan ..... 6-265444

[51] Int. Cl.[7] ..... B41J 29/393

[52] U.S. Cl. ..... 347/19

[58] Field of Search ..... 347/13, 19, 42; 358/504, 406

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,596,995 | 6/1986 | Yamakawa et al. | 346/160 |
| 4,608,577 | 8/1986 | Hori . | |
| 4,723,129 | 2/1988 | Endo et al. . | |
| 4,740,796 | 4/1988 | Endo et al. . | |
| 5,016,023 | 5/1991 | Chan et al. . | |
| 5,038,208 | 8/1991 | Ichikawa et al. | 358/75 |
| 5,098,503 | 3/1992 | Drake | 156/299 |
| 5,157,411 | 10/1992 | Takekoshi et al. | 346/1.1 |
| 5,202,773 | 4/1993 | Kato | 358/461 |
| 5,343,231 | 8/1994 | Suzuki . | |
| 5,353,051 | 10/1994 | Katayama et al. . | |
| 5,502,468 | 3/1996 | Knierim | 347/19 |
| 5,508,826 | 4/1996 | Lloyd et al. | 358/501 |
| 5,510,896 | 4/1996 | Wafler | 358/296 |
| 5,596,353 | 1/1997 | Takada et al. | 347/19 |
| 5,610,369 | 3/1997 | Takada et al. | 347/19 |

FOREIGN PATENT DOCUMENTS

| | | |
|---|---|---|
| 0421806 | 4/1991 | European Pat. Off. . |
| 0440492 | 8/1991 | European Pat. Off. . |
| 0452157 | 10/1991 | European Pat. Off. . |
| 0605216 | 7/1994 | European Pat. Off. . |
| 0670219 | 9/1995 | European Pat. Off. . |
| 54-056847 | 5/1979 | Japan . |
| 55-132253 | 10/1980 | Japan . |
| 59-123670 | 7/1984 | Japan . |
| 59-138461 | 8/1984 | Japan . |
| 60-071260 | 4/1985 | Japan . |
| 2002009 | 1/1990 | Japan . |
| 4229278 | 8/1992 | Japan . |
| 4232749 | 8/1992 | Japan . |
| 5024192 | 2/1993 | Japan . |
| 7242004 | 9/1995 | Japan . |

*Primary Examiner*—Eddie C. Lee
*Assistant Examiner*—Christopher Mahoney
*Attorney, Agent, or Firm*—Fitzpatrick, Cella, Harper & Scinto

[57] ABSTRACT

A method and apparatus for correcting a full-line printing head, which has a high printing quality, at a high yield, as well as a printhead corrected by this apparatus and a printer using this printhead. In the final stage of a semiconductor manufacturing process, the manufactured printhead is made to perform an experimental printing operation to print a predetermined dot pattern. The dot pattern is imaged by a CCD camera and image processing is executed to obtain an image signal. A plurality of pixels (4×32 dots) from among the pixels represented by the image signal are gathered together, the white or black pixels among these are counted and binarization is performed by comparing the count with a predetermined threshold value. Correction data for adjusting the amount of ink discharged from each nozzle of the printhead is generated based upon the binarized data, and the correction data is written in a memory provided in the printhead.

30 Claims, 16 Drawing Sheets

METHOD AND APPARATUS FOR CORRECTING PRINTHEAD, PRINTHEAD CORRECTED BY THIS APPARATUS, AND PRINTING APPARATUS USING THIS PRINTHEAD

BACKGROUND OF THE INVENTION

This invention relates to a method and apparatus for correcting a printhead, a printhead corrected by this apparatus, and a printing apparatus using this printhead. More particularly, the invention relates to a method and apparatus for correcting, by way of example, a full-line printhead equipped with a plurality of printing elements corresponding to the printing width of a recording medium, a printhead corrected by this apparatus, and a printing apparatus using this printhead.

A printer or the printing section of a copying machine or facsimile machine is so adapted as to print an image, which comprises a dot pattern, on a recording medium such as a paper, a thin plastic sheet or fabric based upon image information.

Among these printing apparatuses, those which are the focus of attention because of their low cost are mounted with printheads that rely upon the ink-jet method, the thermosensitive-transfer method or the LED method, etc., in which a plurality of printing elements corresponding to dots are arrayed on a base.

In a printhead in which these printing elements are arrayed to correspond to a certain printing width, the printing elements can be formed through a process similar to a semiconductor manufacturing process. Accordingly, a transition is now being made from a configuration in which the printhead and driving integrated circuitry are arranged separately of each other to an integrated assembled configuration in which the driving integrated circuitry is structurally integrated within the same base on which the printing elements are arrayed. As a result, complicated circuitry involved in driving the printhead can be avoided and the printing apparatus can be reduced in size and cost.

Among these types of printing methods, the ink-jet printing method is particularly advantageous. Specifically, according to this method, thermal energy is made to act upon ink and the ink is discharged by utilizing the pressure produced by thermal expansion. This method is advantageous in that the response to a printing signal is good and it is easy to group the orifices close together at a high density. There are greater expectations for this method in comparison with the other methods.

When the printhead is manufactured by applying a semiconductor manufacturing process and, in particular, when numerous printing elements that are to be made to correspond to the printing width are arrayed over the entire area of a base, it is very difficult to manufacture all of the printing elements without any defects. As a consequence, the manufacturing yield of the process for manufacturing the printhead is poor and this is accompanied by higher cost. There are occasions where such a printhead cannot be put into practical use because of the costs involved.

Accordingly, methods of obtaining a full-line printhead have been disclosed in the specifications of Japanese Patent Application Laid-Open (KOKAI) Nos. 55-132253, 2-2009, 4-229278, 4-232749 and 5-24192 and in the specification of U.S. Pat. No. 5,016,023. According to these methods, a number of high-yield printheads each having an array of printing elements of a comparatively small number of orifices, e.g., 32, 48, 64 or 128 printing elements, are placed upon (or upon/below) a single base at a high precision in conformity with the density of the array of printing elements, thereby providing a full-line printhead whose length corresponds to the necessary printing width.

It has recently become possible on the basis of this technique to simply manufacture a full-line printhead by arraying printing elements of a comparatively small number (e.g., 64 or 128) of orifices on bases (also referred to as "printing units") and bonding these printing units in a row on a base plate in highly precise fashion over a length corresponding to the necessary printing width.

Though it has thus become easy to manufacture a full-line printhead, certain performance-related problems remain with regard to a printhead manufactured by the foregoing manufacturing method. For example, a decline in printing quality, such as density unevenness, cannot be avoided. The cause is a variation in performance from one printing unit (base) to another in the row of such printing units, a variation in the performance of neighboring printing elements between the arrayed printing units and heat retained in each driving block at the time of recording.

In particular, in the case of an ink-jet printhead, not only a variation in the neighboring printing elements between the arrayed printing units but also a decline in ink fluidity owing to the gaps between printing units results in lower yield in the final stage of the printhead manufacturing process. For this reason, the state of the art is such that these printheads are not readily available on the market in large quantities regardless of the fact these printheads exhibit highly satisfactory capabilities.

SUMMARY OF THE INVENTION

Accordingly, an object of the present invention is to provide an apparatus and method for correcting a manufactured printhead, wherein it is possible to realize a printhead at low cost and high yield without subjecting the printhead to much load and without inviting a decline in printing quality, such as a decline in quality caused by visible density unevenness.

According to one aspect of the present invention, the foregoing object is attained by providing an apparatus for correcting a printing characteristic of a printhead having a plurality of printing elements and memory means for storing data, comprising printhead drive means for driving the printhead to perform experimental printing on a recording medium, detecting means for detecting, based on an image that has been printed on the recording medium, a variation in density per a plurality of pixels selected upon taking human visual discriminating ability into account, correction-data generating means for generating, per the plurality of printing elements, correction data for correcting the variation in density detected by said detecting means, and writing means for writing the correction data in said memory means of the printhead.

The detecting means in the apparatus includes reading means for reading the recorded image, image processing means for processing an image signal representing the image read by the reading means, counting means for counting the number of black pixels or white pixels per the plurality of pixels from the image signal that has been subjected to image processing, and binarizing means for comparing the number of black pixels or white pixels obtained by the counting means with a predetermined threshold value, thereby binarizing the number of black pixels or white pixels, and the correction-data generating means generates the correction data based upon the binarized value.

According to another aspect of the present invention, the foregoing object is attained by providing a method of correcting a printing characteristic of a printhead having a plurality of printing elements and a memory unit for storing data, said method comprising a testing step of performing experimental printing on a recording medium using the printhead, a detecting step of detecting, based on an image that has been printed on the recording medium, a variation in density per a plurality of pixels selected upon taking human visual discriminating ability into account, a correction-data generating step of generating, per the plurality of printing elements, correction data for correcting the variance in density detected in said detecting step, and a writing step of writing the correction data in the memory unit of the printhead.

In accordance with the invention as described above, a printhead having a plurality of printing elements and memory means capable of storing information is mounted, experimental printing is performed on a recording medium, a variation in density per a plurality of pixels selected upon considering human visual discriminating ability is detected from the image printed on the recording medium, correction data for correcting the detected variation in density is generated per the plurality of printing elements and this correction data is transmitted to the memory means possessed by the printhead.

Another object of the present invention is to provide the above-mentioned printhead and a printing apparatus using the printhead.

According to one aspect of the above invention, the foregoing object is attained by providing a printhead corrected by the above-described printhead correction apparatus.

Further, the printhead has input means for inputting printing data from an external unit, and drive means for driving the plurality of printing elements based upon the printing data inputted by the input means.

According to another aspect of the above invention, the foregoing object is attained by providing a printing apparatus using the above-described printhead, comprising receiving means for receiving the correction data from the printhead, control means which, on the basis of the correction data, generates a control signal for controlling operation of the drive means in such a manner that the printing elements form uniform pixels, and transmitting means for transmitting the control signal to the printhead.

The control signal in this printing apparatus includes a first pulse signal and a second pulse signal that follows the first pulse signal, and the control means adjusts the width of the first pulse signal, the width of the second pulse signal and the pulse interval between the first and second pulse signals, based on the correction data.

In accordance with the invention as described above, the printhead corrected as set forth above is mounted on a printing apparatus, the correction data that has been stored in the memory means of the printhead is received, a control signal is generated on the basis of the correction data to control the operation of the drive means, with which the printhead is provided, in such a manner that the plurality of printing elements of the printhead form uniform pixels, and the control signal is sent to the printhead.

In accordance with an embodiment of the printing apparatus, the control signal includes the first pulse signal and the second pulse signal that follows the first pulse signal, and the width of the first pulse signal, the width of the second pulse signal and the pulse interval between the first and second pulse signals are adjusted in the printing apparatus on the basis of the correction data received from the printhead.

Thus, according to the invention, a printhead having a plurality of printing elements and memory means capable of storing information is mounted, experimental printing is performed on a recording medium, a variation in density per a plurality of pixels selected upon considering human visual discriminating ability is detected from the image printed on the recording medium, correction data for correcting the detected variation in density is generated per the plurality of printing elements and this correction data is transmitted to the memory means possessed by the printhead. As a result, the invention is particularly advantageous in that it is possible to correct, in simple fashion, a printhead at low cost and high yield without complicating the manufacturing process and without inviting a decline in printing quality, such as a decline in quality caused by visible density unevenness.

In particular, in a case where a printhead having a very large number of printing elements extending across the printing width of the recording medium is corrected, the invention is effective in that a variation in printing density ascribable to the printing elements is eliminated.

Further, in accordance with another aspect of the present invention, a printing apparatus mounted with the printhead corrected as set forth above is such that the correction data that has been stored in the memory means of the printhead is received, a control signal is generated on the basis of the correction data to control the operation of the drive means, with which the printhead is provided, in such a manner that the plurality of printing elements of the printhead form uniform pixels, and the control signal is sent to the printhead. As a result, an advantage of the invention is that it is possible to perform high-quality printing without visible density unevenness.

Further, in accordance with another aspect of the present invention, the control signal includes the first pulse signal and the second pulse signal that follows the first pulse signal, and the width of the first pulse signal, the width of the second pulse signal and the pulse interval between the first and second pulse signals are adjusted in the printing apparatus on the basis of the correction data received from the printhead. As a result, high-quality image printing is obtained without the application of long pulses that subjects the printhead to a heavy load. This contributes to extending a lifetime of the printhead.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail with reference to the accompanying drawings.

<Overview of the Apparatus>

Figure 1:
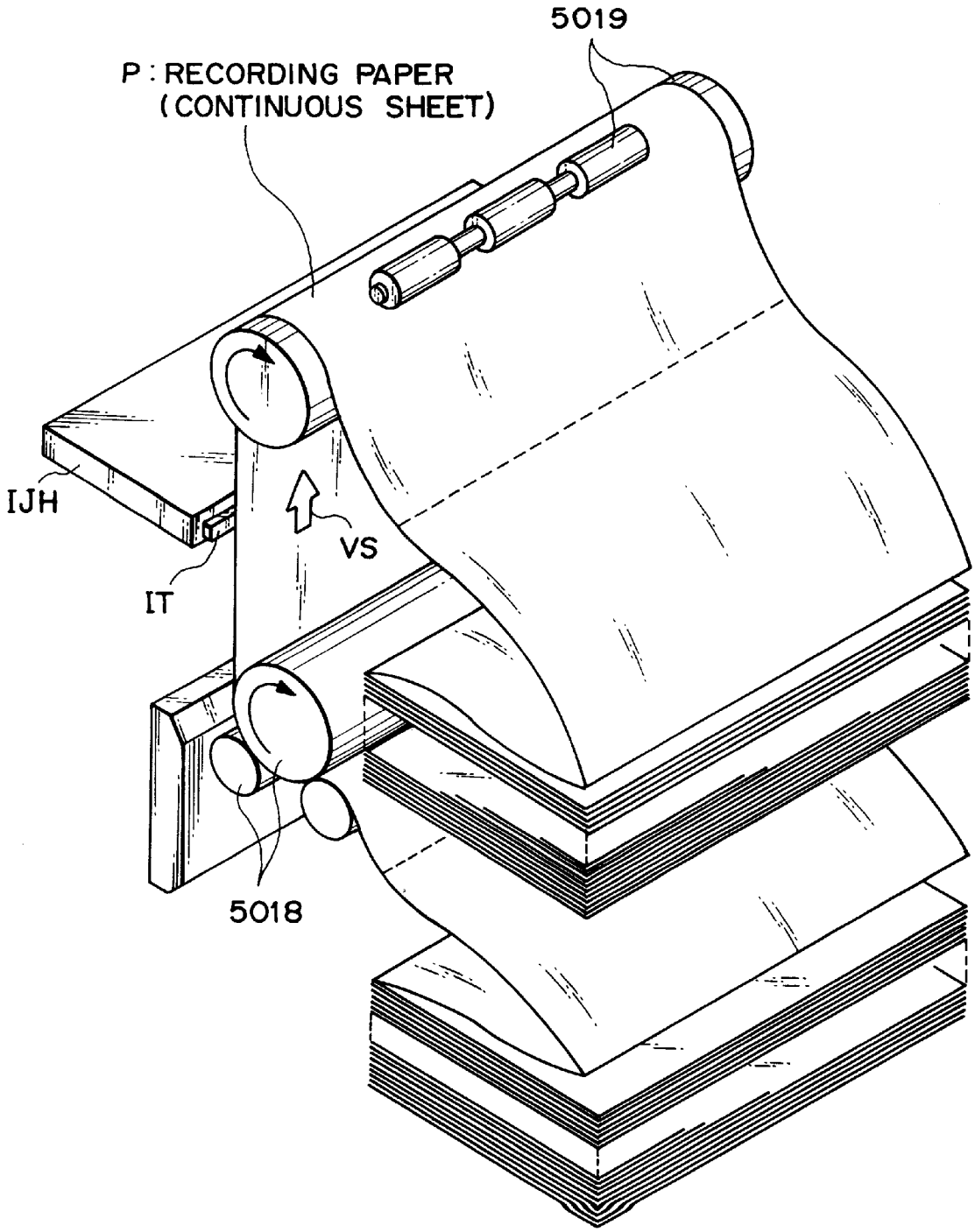
FIG. 1 is a general view of a full-line ink-jet printer, which is a typical embodiment of the present invention.

FIG. 1 is an external perspective view showing the principal portions of an ink-jet printer IJRA, which is a typical embodiment of the present invention. As shown in FIG. 1, the printer has a printhead (a full-length multiple printhead) IJH arranged along a range of full width of recording paper (a continuous sheet) P. The printhead IJH discharges ink over a range extending across the full width of the recording paper P. The ink is discharged toward the recording paper P from an orifice IT of the printhead at a prescribed timing.

In this embodiment, the continuous sheet of foldable recording paper P is conveyed in the direction VS in FIG. 1 by driving a conveying motor under the control of a control circuit, described below. An image is printed on the recording paper. The printer in FIG. 1 further includes sheet feeding rollers 5018 and discharge rollers 5019. The discharge rollers 5019 cooperate with the sheet feeding rollers 5018 to hold the continuous sheet of recording paper P at the printing position and operate in association with the sheet feeding rollers 5018, which are driven by a drive motor (not shown), to feed the recording paper P in the direction of arrow VS.

Figure 2:
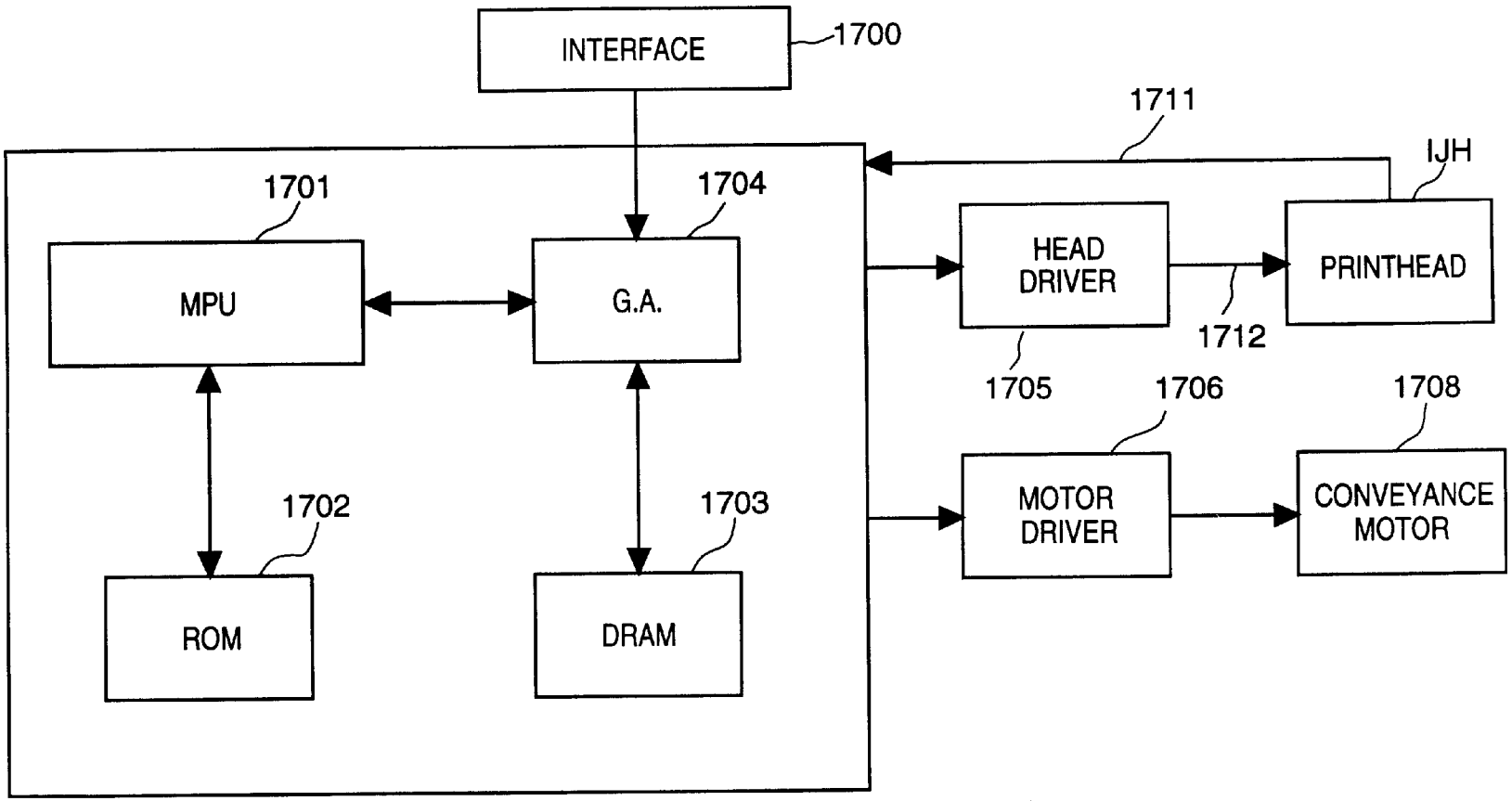
FIG. 2 is a block diagram showing a control configuration for executing control of printing in the ink-jet printer.

FIG. 2 is a block diagram illustrating the construction of the control circuit of the ink-jet printer. Shown in FIG. 2 are an interface 1700 for entering a printing signal from an external device such as a host computer, an MPU 1701, a ROM 1702 for storing a control program (inclusive of character fonts as necessary) executed by the MPU 1701, a DRAM 1703 for temporarily saving various data (the above-mentioned printing signal and printing data that is supplied to the printhead), and a gate array (G.A.) 1704 for controlling supply of printing data to the printhead IJH. The gate array 1704 also controls transfer of data among the interface 1700, MPU 1701 and RAM 1703. Also shown are a conveyance motor 1708 for conveying recording paper (the continuous sheet in this embodiment), a head driver 1705 for driving the printhead, and a motor driver 1706 for driving the conveyance motor 1708.

As for the general operation of the above-mentioned control circuit, the printing signal enters the interface 1700, whereupon the printing signal is converted to printing data for printing between the gate array 1704 and MPU 1701. The motor driver 1706 is driven into operation and the printhead IJH is driven in accordance with the printing data sent to the head driver 1705. As a result, a printing operation is carried out.

Figure 11:
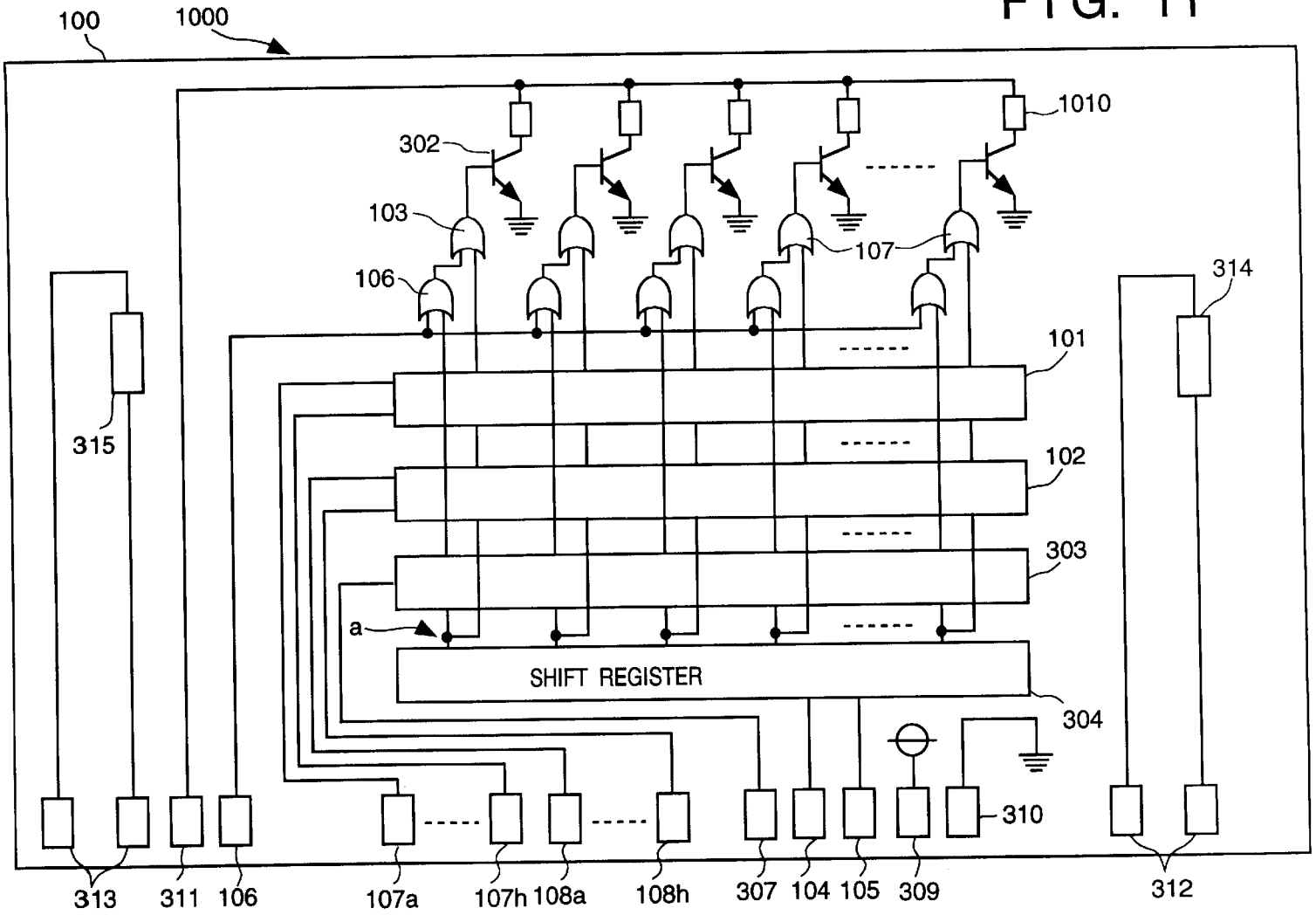
FIG. 11 is a diagram showing an example of the circuit arrangement of a drive circuit provided on the heater board for the printhead.

Numeral 1711 denotes a signal line for monitoring sensors (e.g., a heating-resistor sensor 314 and a temperature sensor 315, which are shown in FIG. 11) of each board, and for transmitting correction data from a memory 13 (described later) storing correction data which corrects for a variation in each board (heater board 1000, described later) provided within the printhead IJH. Numeral 1712 denotes a signal line for carrying preheating pulses, latch signals and heating pulses. On the basis of the correction data from the memory 13 in the printhead IJH, the MPU 1701 sends the printhead IJH a control signal via the signal line 1712 in such a manner that the boards are capable of forming uniform pixels.

Figure 3:
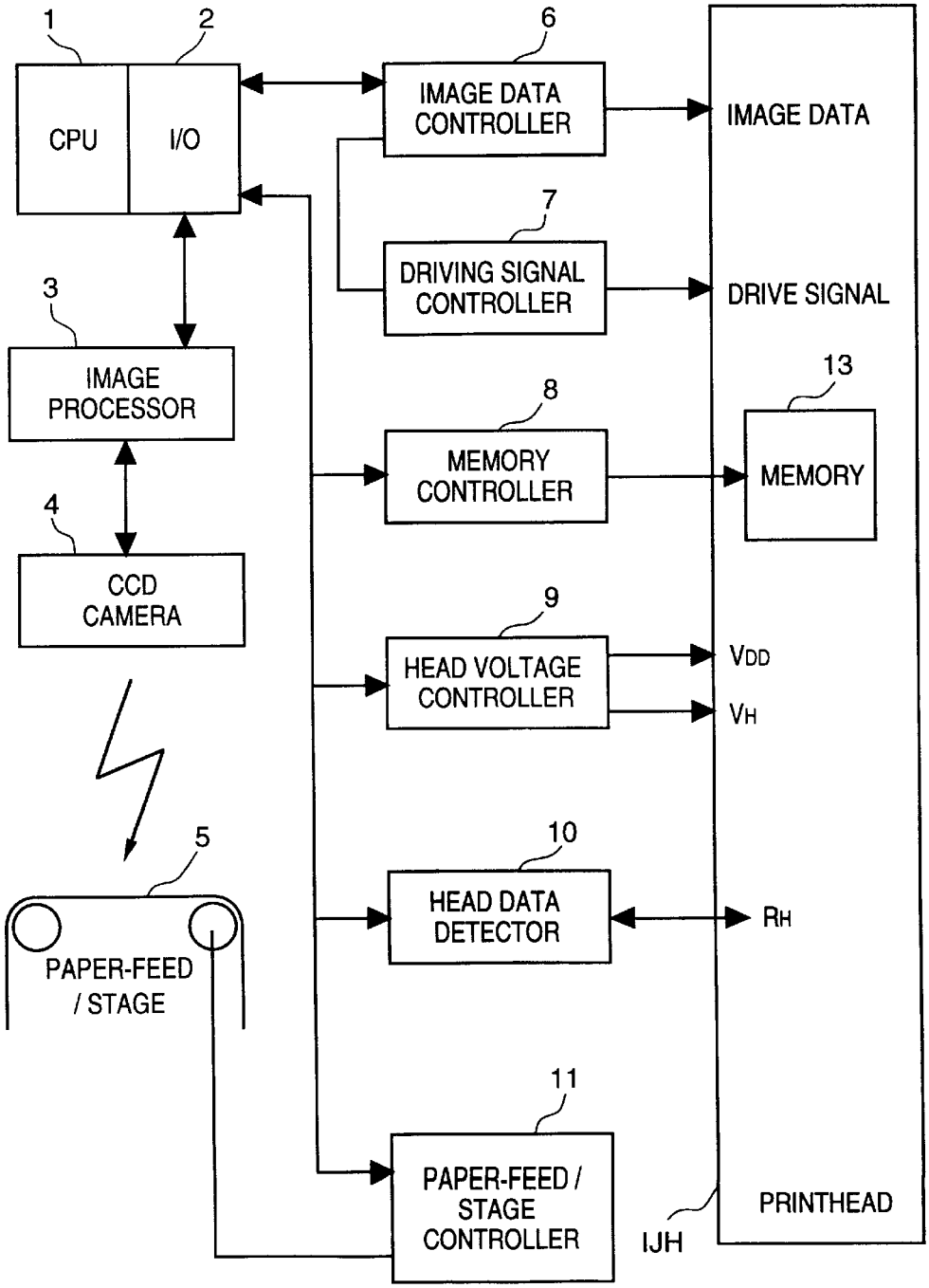
FIG. 3 is a block diagram showing the construction of a printhead correction apparatus according to this embodiment.

FIG. 3 is a block diagram illustrating the construction of the printhead correction apparatus of this embodiment. An I/O interface 2 interfaces the CPU 1 with the various controllers of the apparatus. An image processor 3 uses a CCD camera 4 to read the printing dot pattern on a recording medium placed upon a paper feeding stage 5 and converts the dot diameter and density unevenness of the dot pattern to pixel values. When the dot data corresponding to all printing elements of the printhead IJH is sent from the image processor 3 to the CPU 1, the latter operates upon the dot data, sends density correction data to a driving signal controller 7 in conformity with a drive signal for driving the printhead IJH and causes a memory controller 8 to develop the density correction data.

An image data controller 6 outputs a dot pattern to be recorded to the printhead IJH. The controller 6 transmits a density correction drive signal while sending a synchronizing signal to the drive signal controller 7 not only at the time of ordinary printing but also when the density correction data has been determined. The CPU 1 manages a head voltage controller 9 which controls the driving voltage of the printhead IJH and manages a stage/paper-feed controller 11 for controlling the operation of the paper feeding stage 5, thereby setting a proper drive voltage and controlling stage movement and paper feed. Furthermore, a head data detector 10 is an important component which feeds back, for the purpose of density correction, the characteristics of each board (printing unit) 1000 (see FIG. 7) within the printhead IJH.

In the printhead IJH which, by way of example, is composed of a row of a plurality boards 1000 on which 64 or 128 printing elements have been disposed, it is not known from which portions of a silicon wafer or the like the boards 1000 have been cut. Accordingly, there are cases in which the characteristics differ from one board to another.

In such case, a rank detecting resistor element RH having a surface resistivity (Ω/□) identical with that of the printing element is provided in each board 1000 in order that all printheads can perform printing at uniform density. There are also cases in which a semiconductor element capable of monitoring a change in temperature is provided for each board 1000. The head data detector 10 monitors these elements. When the head data detector 10 sends data obtained by monitoring these elements to the CPU 1, the latter generates correction data, which is for correcting the data that drives each of the boards 1000, in such a manner that each board 1000 in the printhead can print at a uniform density. The rank mentioned here is a parameter obtained by quantifying the characteristic of each board 1000. The parameter is expressed by a function of a surface resistivity (Ω/□).

When the above-mentioned correction data is reflected in each controller of the printhead correction apparatus, the printing operation by the printhead IJH is executed under these conditions. In the correcting apparatus, the results of printing are again subjected to image processing by the CCD camera 4 and image processor 3, and the memory controller 8 writes the final correction data in the memory 13 (a non-volatile memory such as an EEPROM) at a stage at which the predetermined criteria of the printhead is satisfied.

Figure 4:
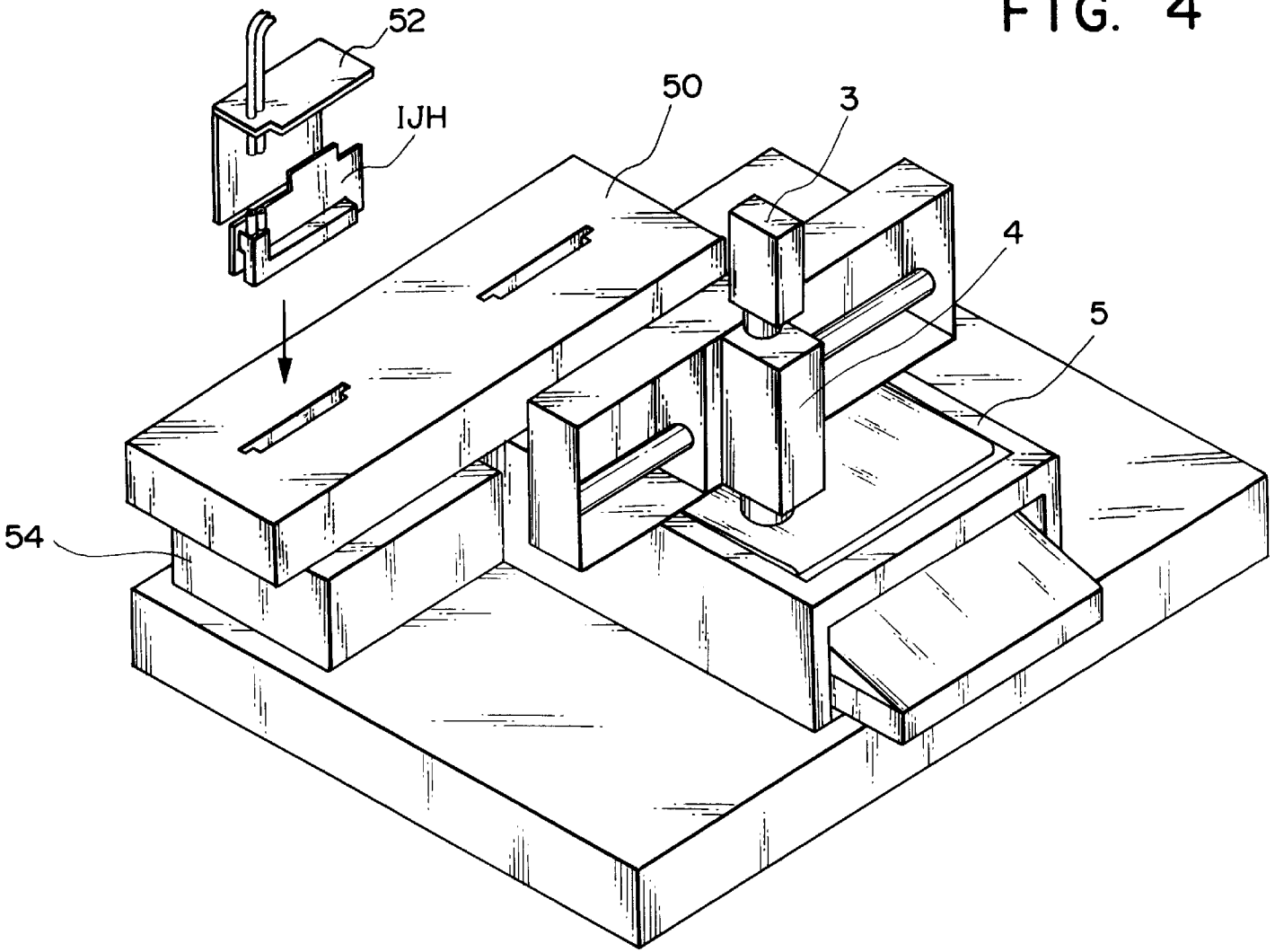
FIG. 4 is a perspective view showing the construction of the printhead correction apparatus.
Figure 5:
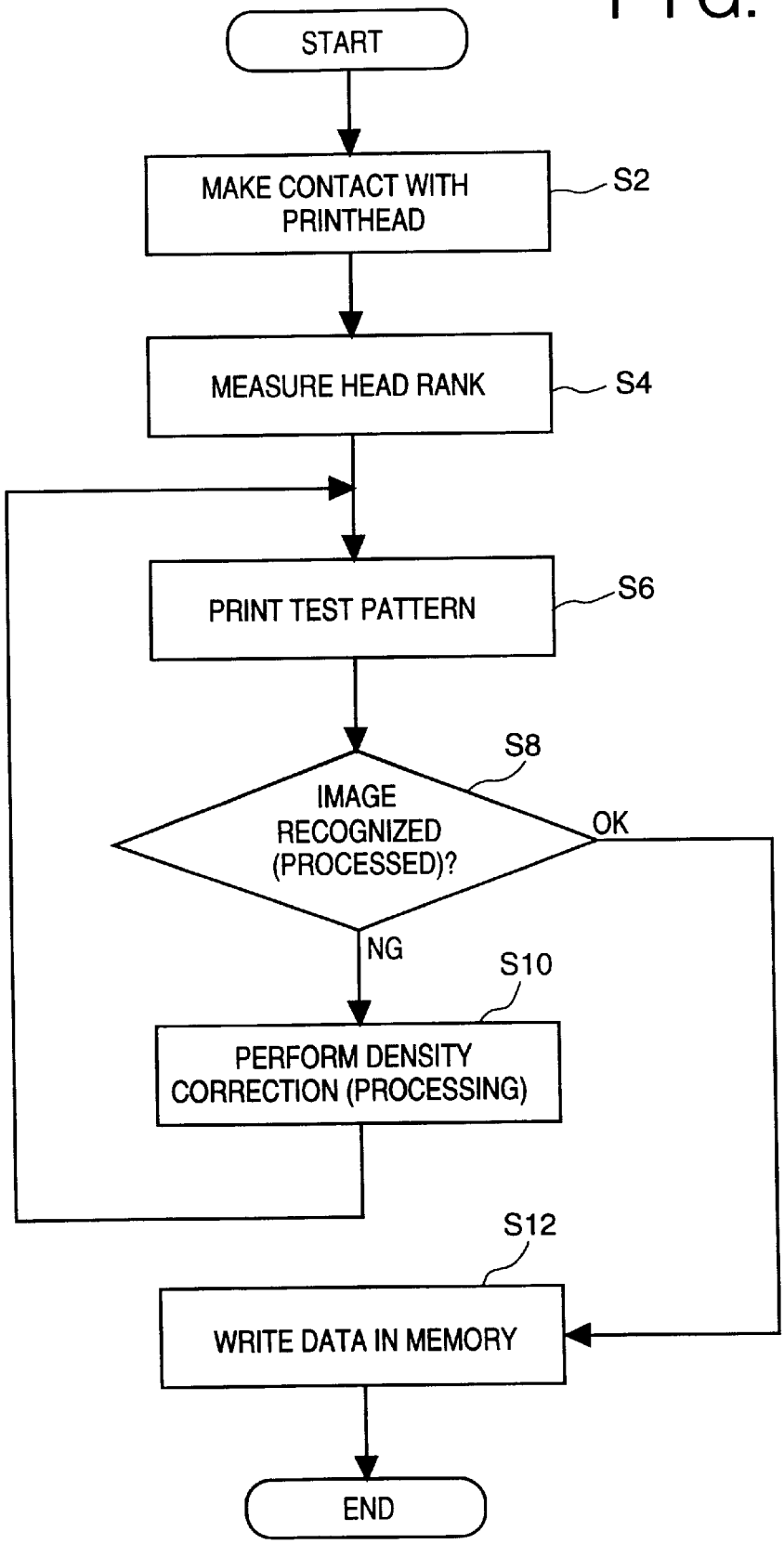
FIG. 5 is a flowchart showing the operation of the printhead correction apparatus.

FIG. 4 is an external perspective view showing the construction of the printhead correction apparatus, and FIG. 5 is a flowchart illustrating the operation of the apparatus. Operation will now be described with reference to FIGS. 4 and 5.

When the printhead IJH is inserted into a slot of a securing table 50, the CPU 1 operates the table 50 and fixes the printhead IJH to the table 50 in such a manner that the printhead IJH can perform printing at a normal position. At the same time, electrical contact is made with the printhead IJH, and an ink supply device 52 is connected to the printhead IJH (step S2). Next, in order to measure the rank of the printhead IJH, the surface resistivity (Ω/□) of the substrate 1000 is monitored (step S4).

In the case of a full-line printhead unit, the surface resistivity (Ω/□)) of each block (of each board in a case where the block is constituted by an array of a plurality of boards) is monitored, driving power is decided separately for each board and a test pattern is recorded (step S6). As preprocessing for printing the test pattern, preliminary discharge (aging) is carried out until the operation of the printhead IJH stabilizes to enable stable printing by the printhead. Aging is performed on an aging tray juxtaposed on a head recovery processor 54, and recovery processing (ink suction, cleaning of orifice surfaces, etc.) is executed in such a manner that the test pattern can be printed normally. When a test pattern is thus printed, the result of printing is moved to the position of the CCD camera 4 and of the image processor 3, where the result of printing is subjected to image processing by these components and compared with parameters for printing evaluation. Processing is executed while taking the items mentioned below into account in relation to density unevenness of recording elements. Density unevenness is a parameter that can be improved.

Density unevenness of an image is produced by a difference in relative density contrast in printing performed by printing elements. The smaller the contrast, the less noticeable density unevenness is to the eye. When printing elements which produce a high-density printing are concentrated somewhat closely together in space, the occurrence of density unevenness becomes apparent.

When the limit on visual discriminating ability is put into the form of a formula from the viewpoint of density unevenness, the following relation is obtained from experiment:

$$\Delta OD = 0.02 \times \Delta Vd$$

(where Vd is the amount of ink discharge.) This equation shows that a disparity in amount of discharge of 1~4 pl (picoliters) results in a change of 0.02~0.08 in terms of the OD value. In an actual image, density unevenness results from a collection of printing dots causing variation. If a difference in amount of ink discharge on the order of 4 pl occurs between mutually adjacent printing elements, a fairly large difference in contrast is produced between these printing elements. However, in case of a printing density on the order of 300~600 dpi, it is impossible for the human eye to compare density unevenness between mutually adjacent dots in dot units.

When the discriminating limit of the human eye with respect to density unevenness in an image is taken into account, density unevenness data near the discriminating ability of the human eye can be created by (1) performing a density unevenness correction in units of several dots (two to eight pixels, depending upon printing density); and (2) increasing the number of events of image processing (the number of events per printed dot or the number of events in a group of printed dots (16~1024 dots)).

A procedure for creating such density unevenness data will now be described in detail.

Figure 6:
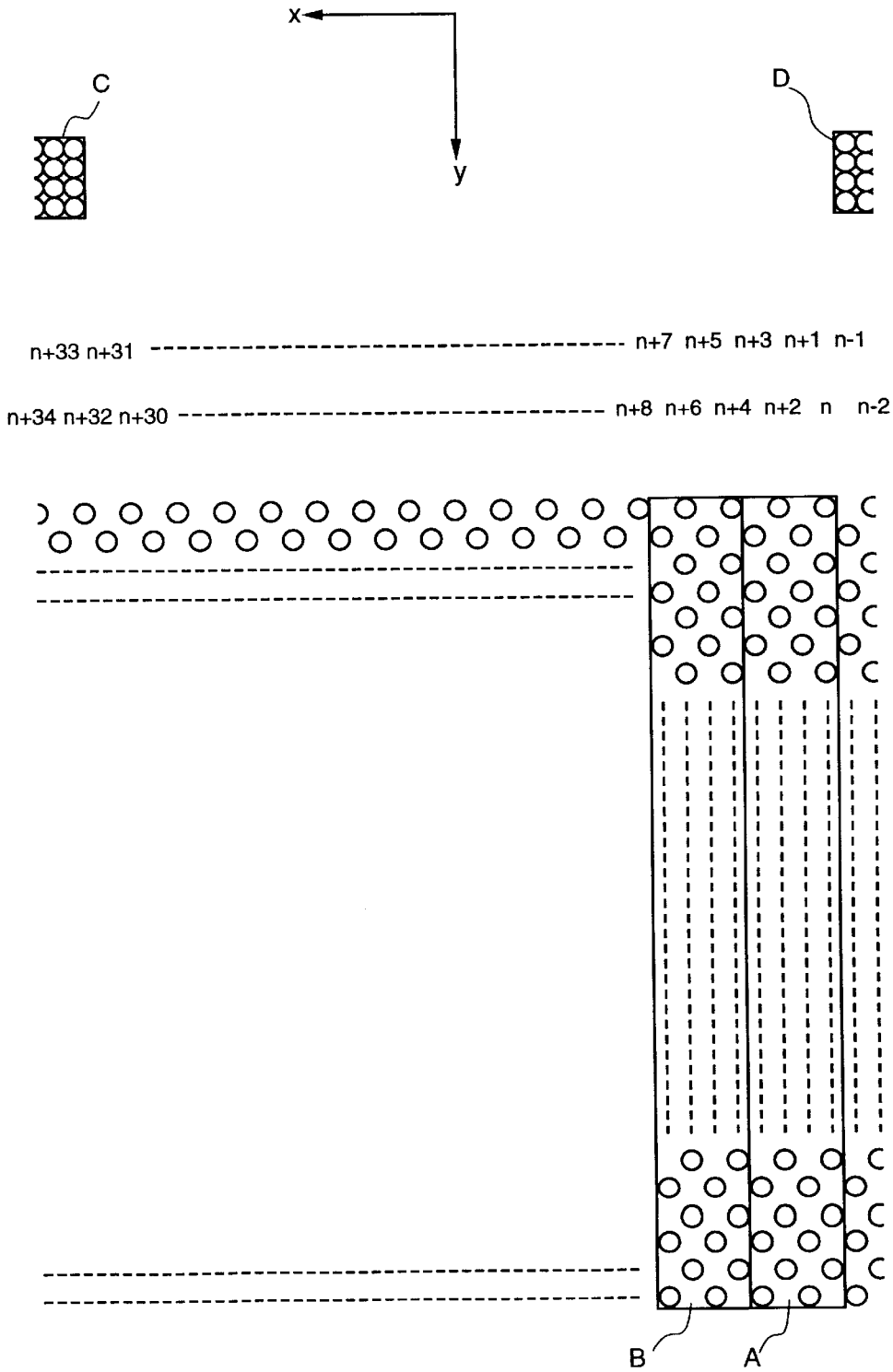
FIG. 6 is a diagram illustrating a test pattern for correcting density using this embodiment.

FIG. 6 illustrates an example of an image pattern read by a CCD camera or the like. In FIG. 6, a dot pattern having a 50% duty is formed and a dot pattern of 32 dots=32 dots is allocated to the screen area of the CCD camera. In FIG. 6, A and B are areas of 4×32 dots each. In this embodiment, each is one event. Further, C and D in FIG. 6 are disposed as markers for image recognition of the dot pattern of 32×32 dots.

Let n represent the first dot read. The area A constituting one event is composed of a collection of 32 bits in the y direction (the direction in which the recording medium is conveyed) from n to n+3 in the x direction (the column direction of the printing elements). Eight similar areas are produced in an image memory (not shown), and binarizing processing is performed in each area in accordance with the number of "black" or "white" pixels in the area and a predetermined threshold value. It should be noted that an optimum value obtained experimentally is used as the threshold value. As the result of this binarizing processing, density unevenness data is obtained for every four dots in the x direction.

Further, adopting the absolute density (the total number of black pixels) in each area as the density unevenness data also is effective.

Furthermore, an image having an area corresponding to more than 100 dots per one nozzle of a printing element can be read in and processed by an image scanner, wherein the dot pattern has the 50% duty shown in FIG. 6, and the processed results can be used as the density unevenness data.

Since an event number of more than 100 dots (100 printing operations) per nozzle is obtained with this method, a subtle fluctuation in dot diameter in relation to the y direction is averaged. When density unevenness is discriminated by the human eye, the fluctuation in the y direction is not very noticeable. However, when the number of events is small, the density unevenness does not become a density unevenness that can be visually recognized by the human eye and is not appropriate as density unevenness data. The reason is that the data does not become statistical data that is meaningful to the extent that it can be visually discerned by the human eye. If density unevenness data in dot units is obtained in the x direction, several dots of the data can be collected and adopted as density unevenness data. In this case an arrangement may be adopted in which it is possible to externally set the number of dot units. In order to create correction data in units of four dots, as mentioned above, the density unevenness data in units of four dots in the x direction may be averaged.

The density unevenness data thus obtained does not have a complicated structure and can be processed in a short period of time in both a printhead manufacturing apparatus and a printer.

With regard to the density unevenness data every four dots obtained as described above, the same data is provided for every four nozzles of the printing.

When density unevenness data is thus obtained, how each element is to be corrected is decided based upon this data. For example, in a case where the driving power of each recording element of the printhead is decided by pulse width, driving, pulse-width data applied to an integrated circuit for driving the printhead is selected. As will be described later, in a case where the pulse-width control circuit of the driving integrated circuit makes a selection from several pulse widths, the MAX, MIN of the pulse width selected are decided and a pulse width between these values is set based upon the resolution allowed. The pulse width is set so as to correct the printing density of each element in conformity with the image processing data, and the pulse width is made to correspond to each printing element, whereby it is possible to average the printing densities of the printhead unit. The foregoing is repeated until the above-described processing is finished. When this occurs, the resulting data is stored in the memory 13. This processing is carried out at steps S8~S12 in FIG. 5.

Note that this embodiment can reduce the number of testings performed until it is determined at step S8 that the testing is OK, compared to U.S. patent application Ser. No. 08/397,352 filed on Mar. 2, 1995.

U.S. patent application Ser. No. 08/397,352 (Japanese Laid-Open Patent Application No. 7-242004) discloses a method of correcting the unevenness in the density of a printhead by measuring dot diameter and correcting unevenness based upon the results of measurement. However, it is still necessary to improve reproducibility of printed dots. For example, when one line of printing has been performed, the characteristics of the printed dots change subtly on the next line, over then next several dozen lines and over the next several hundred lines. (This is known as "fluctuation" from dot to dot.) Since a specific phenomenon (dot diameter) which incorporates this fluctuation is employed as information regarding density unevenness, satisfactory results are not obtained with a single correction. In order to acquire the desired image quality, it is required that printed dot data from several measurements be acquired to perform the correction. In a case where electrical energy is converted to thermal energy in conformity with correction data, energy which is larger than usual is applied to the printing elements that exhibit a low density. Thus, it is highly desirable to further improve reliability in terms of the durability of the printhead.

Figure 7:
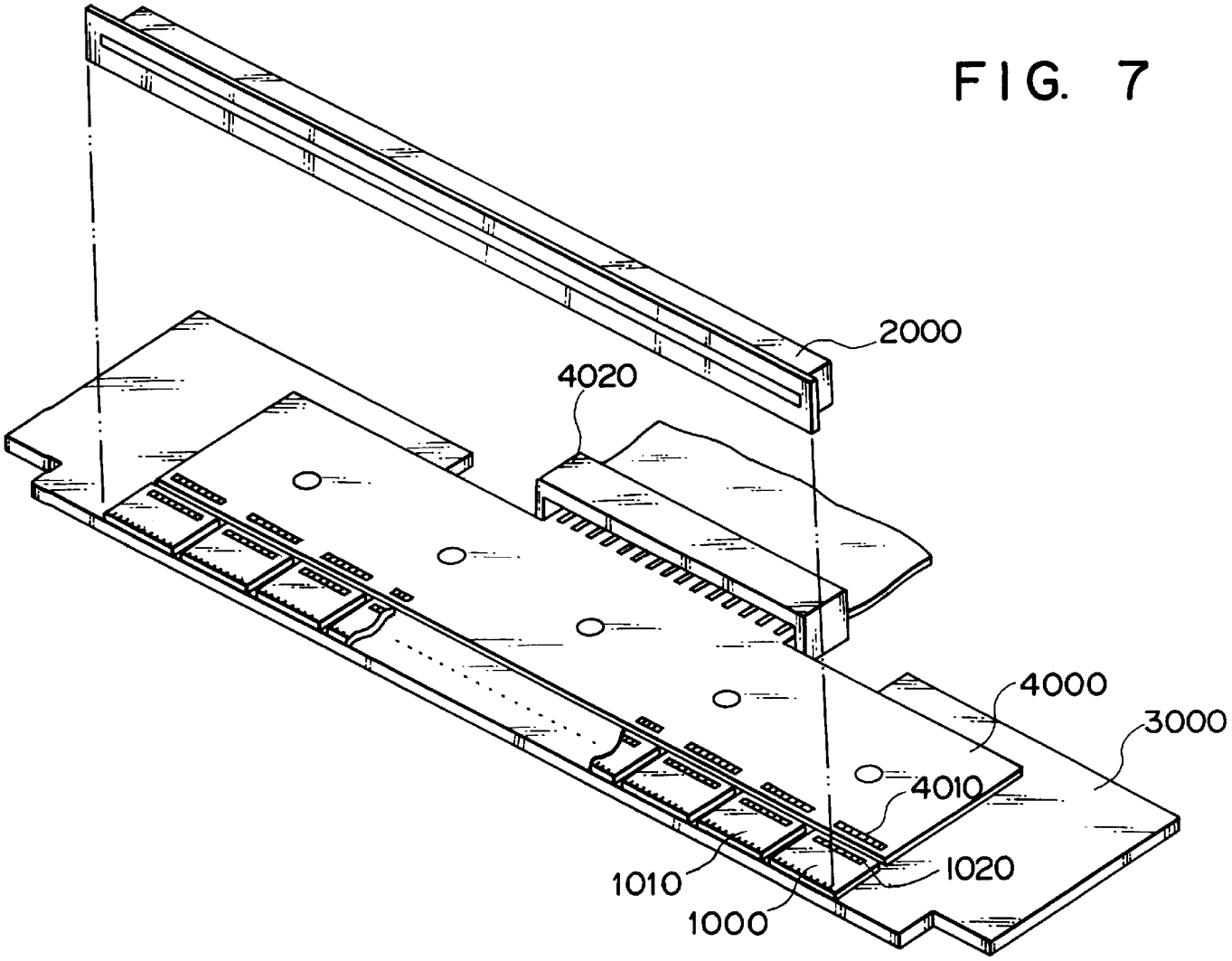
FIG. 7 is an exploded perspective view for describing the construction of a printhead according to the present invention.

FIG. 7 is an exploded perspective view for describing the construction of the printhead of this embodiment. In this example, a case is described in which the printing elements are elements for generating ink-discharge energy used to jet ink. (In a bubble-jet printing method, each element comprises a pair of electrodes and a heating resistor element provided between these electrodes).

In accordance with the method described below, the full-line printhead, which is faultlessly fabricated over its entire width by a conventional photolithographic process or the like, is obtained at a very high yield. Moreover, a single, unitary grooved member having a plurality of ink discharge orifices formed in one end and a plurality of grooves connected to these orifices and formed in the grooved member from one end to the other is joined to this printhead in such a manner that the grooves are closed by the boards, whereby a full-line, ink-jet printhead unit can be corrected in a very simple manner.

The ink-jet printhead described in this embodiment has ink discharge orifices at a density of 360 dpi (70.5 $\mu$m), the number of nozzles thereof being 3008 (for a printing width of 212 mm).

In FIG. 7, the board (hereinafter referred to as a heater board) 1000 has 128 discharge-energy generating devices 1010 arranged at prescribed positions at a density of 360 dpi. Each heater board 1000 is provided with a signal pad to drive the discharge-energy generating devices 1010 at any timing by externally applied electric signals, and with a power pad 1020 for supplying an electric power for the driving.

The row of the heater boards 1000 is fixedly bonded by a bonding agent to the surface of a base plate 3000 made of a material such as metal or ceramic.

Figure 8:
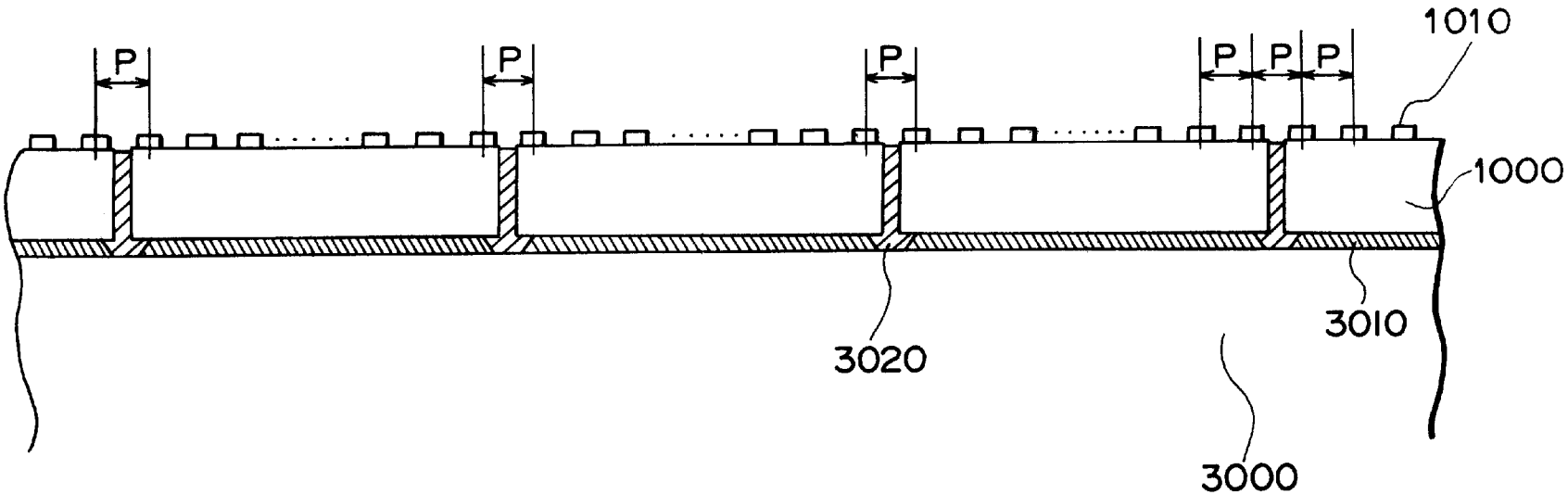
FIG. 8 is a detailed view showing heater boards arranged side by side.

FIG. 8 is a detailed view showing the heater boards 1000 in the arrayed state. The heater boards are fixedly bonded to a prescribed location on the base plate 3000 by a bonding agent 3010 applied to a prescribed thickness. At this time each heater board 1000 is fixedly bonded in precise fashion in such a manner that the spacing or pitch between the discharge-energy generating devices 1010 situated at the respective edges of two mutually adjacent heater boards will be equal to the spacing or pitch P (=70.5 $\mu$m) of the discharge-energy generating devices 1010 on each heater board 1000. Further, the gaps produced between adjacent heater boards 1000 are filled and sealed by a sealant 3020.

With reference again to FIG. 7, a wiring board 4000 is fixedly bonded to the base plate 3000 in the same manner as the heater boards. At this time the wiring board 4000 is bonded to the base plate 3000 in a state in which the pads 1020 on the heater boards 1000 are in close proximity to signal-power supply pads 4010 provided on the wiring board 4000. A connector 4020 for receiving a printing signal and driving power from the outside is provided on the wiring board 4000.

A grooved member 2000 will now be described.

Figure 9D:
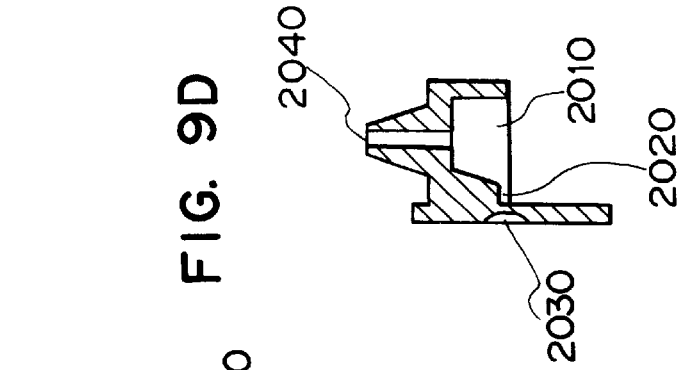
FIGS. 9A, 9B, 9C and 9D illustrate the shape of a grooved member.
Figure 9A:
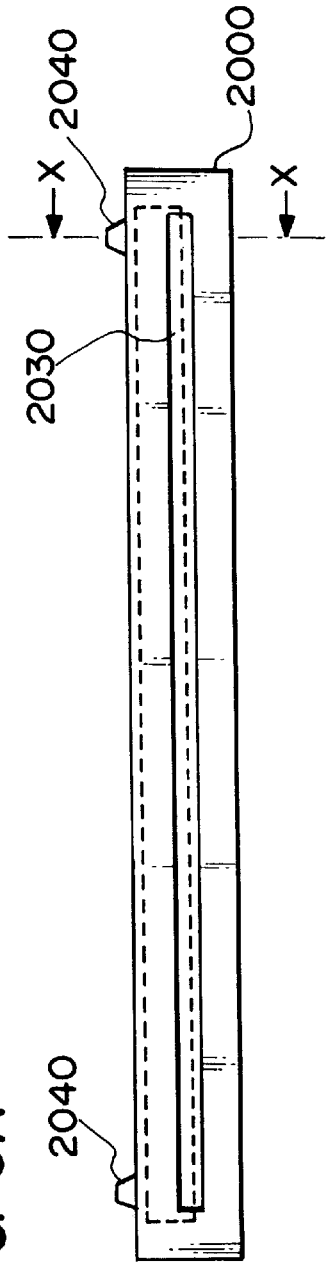
Figure 9B:
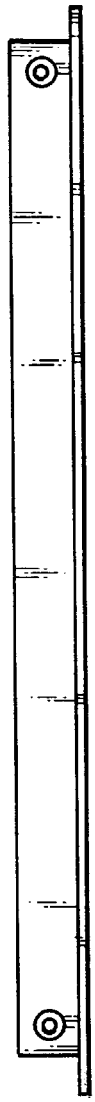
Figure 9C:
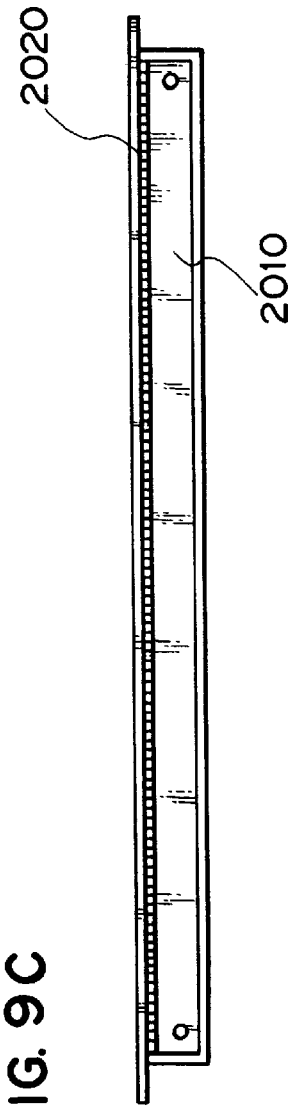

FIGS. 9A~9D are diagrams, showing the shape of the grooved member 2000. FIG. 9A is a front view in which the grooved member 2000 is seen from the front, FIG. 9B a top view in which FIG. 9A is seen from the top, FIG. 9C a bottom view in which FIG. 9A is seen from the bottom, and FIG. 9D a sectional view taken along line X—X of FIG. 9A.

In FIGS. 9A~9D, the grooved member 2000 is shown to have a flow pass 2020 provided to correspond to each discharge-energy generating element 1010 provided in the heater board 1000, an orifice 2030 corresponding to each flow pass 2020 and communicating with the flow pass 2020 for discharging ink toward the recording medium, a liquid chamber 2010 communicating with each flow pass 2020 in order to supply it with ink, and an ink supply port 2040 for feeding ink, which has been supplied from an ink tank (not shown), to the liquid chamber 2010. The grooved member 2000 naturally is formed to have a length large enough to substantially cover the row of discharge-energy generating devices arranged by lining up a plurality of the heater boards 1000.

With reference again to FIG. 7, the grooved member 2000 is joined to the heater boards 1000 in a state in which the positions of the flow pass 2020 of the grooved member 2000 are made to exactly coincide with the positions of the discharge-energy generating elements (heaters) 1010 on the heater boards 1000 arranged in a row on the base plate 3000.

Conceivable methods of joining the grooved member 2000 are a method in which the grooved member is pushed in mechanically using springs or the like, a method in which the grooved member 2000 is fixed by a bonding agent, and a method which is a combination of these methods.

Figure 10:
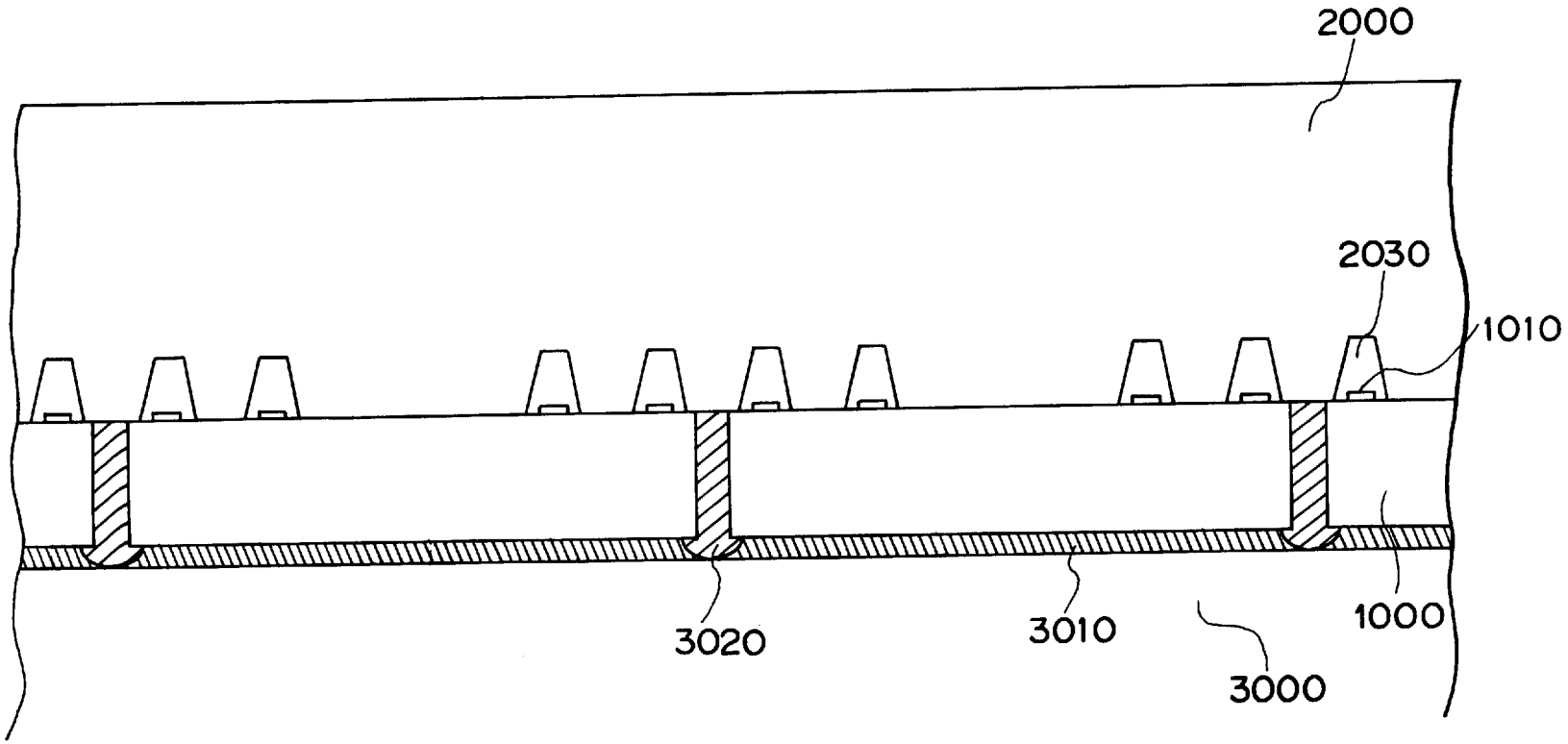
FIG. 10 is a diagram showing the grooved member and heater boards in a fixed state.

The grooved member 2000 and each of the heater boards 1000 are secured in the relationship shown in FIG. 10 by any of these methods.

The grooved member 2000 described above can be manufactured using well-known methods such as machining by cutting, a molding method, casting or a method relying upon photolithography.

FIG. 11 shows an example of drive circuitry provided on the heater board 1000 of the printhead. Numeral 100 denotes a base, 101 a logic block for selecting preheating pulses, 303 a latch for temporarily storing image data, 102 a selection-data saving latch, having the same circuit arrangement as the latch 303, for selecting preheating pulses, and 103 an OR gate for taking the OR of heating pulses and preheating pulses.

The operation of this drive circuitry will now be described in line with a driving sequence.

After power is introduced from a logic power source 309, preheating pulses are selected independence upon the characteristic of the amount of ink discharged (per application of a pulse at a fixed temperature). The characteristic is measured in advance. Data of each nozzle (the data is identical for four nozzles) for selecting the preheating pulses in dependence upon the aforesaid characteristic is saved in the selection-data saving latch 102 using a shift register 304 for entering image data serially. Since shared use is made of the shift register 304 for entering image data, it will suffice merely to increase the number of latch circuits and latch the outputs of the shift register 304 as input signals in parallel fashion, as shown at points a in FIG. 11. This makes it possible to prevent an increase in the surface area of the elements other than that of the latch circuits. Further, in a case where the number of preheating pulses is increased and the number of bits necessary for selection of the number of pulses surpasses the number of bits of the shift register 304, this can readily be dealt with if the latch 102 is made plural in number and a latch-clock input terminal 108 which decides latching is made plural in number, as shown at 108*a*~108*h*. It will suffice if the saving of data for selection of the preheating pulses is performed one time, such as when the printer is started up. The image-data transfer sequence will be performed exactly the same as conventionally even if this function is incorporated. Furthermore, an arrangement may be adopted in which the number of bits in logic block 101 and in the selection-data saving latch 102 is made one-fourth, the preheating pulses are selected in units of four nozzles and are supplied in units of four nozzles.

Entry of heating signals will now be described as a sequence which follows completion of the storing of saved data, representing the amount of ink discharge, for selection of preheating pulses.

A characterizing feature of this board is that a heating input terminal 106 and a plurality of preheating input terminals 107*a*~107*h*, which are used for changing the amount of ink discharged, are separately provided. First, a signal from the heating-resistor monitor 314 is fed back and a heating signal having a pulse width of an energy suited to discharge of ink in dependence upon the value of feedback is applied to the heating input terminal 106 from the side of the printing apparatus. Next, the pulse width and timing of each of the plurality of preheating signals are changed in dependence upon the value from the temperature sensor 315 and, at the same time, preheating signals are applied from the plurality of preheating pulse terminals 107*a*~107*h* in such a manner that the amount of ink discharged will vary under fixed temperature conditions. Thus, if a selection is made to deal with a factor other than temperature, namely a change in the amount of ink discharge of each nozzle, the amount of ink discharge can be rendered constant to eliminate unevenness and blurring. One of the plurality of preheating pulses thus entered is selected in dependence upon selection data saved in advance in the preheat selection logic block (latch) 102. Next, an AND signal between the image data and heating signal is OR-ed with a selected preheating pulse by the OR gate 103, and the resulting signal drives a power transistor 302, thereby passing an electric current through the heater 1010 to discharge ink.

Shown in FIG. 11 are an input signal input terminal 104, a clock input terminal 105, a latch signal input terminal 307, a ground terminal 310, a power-supply voltage input terminal 311 for heating purposes, an output terminal 312 for heating-resistor monitoring data, and an output terminal 313 for data indicating the temperature inside the printhead.

Figure 12:
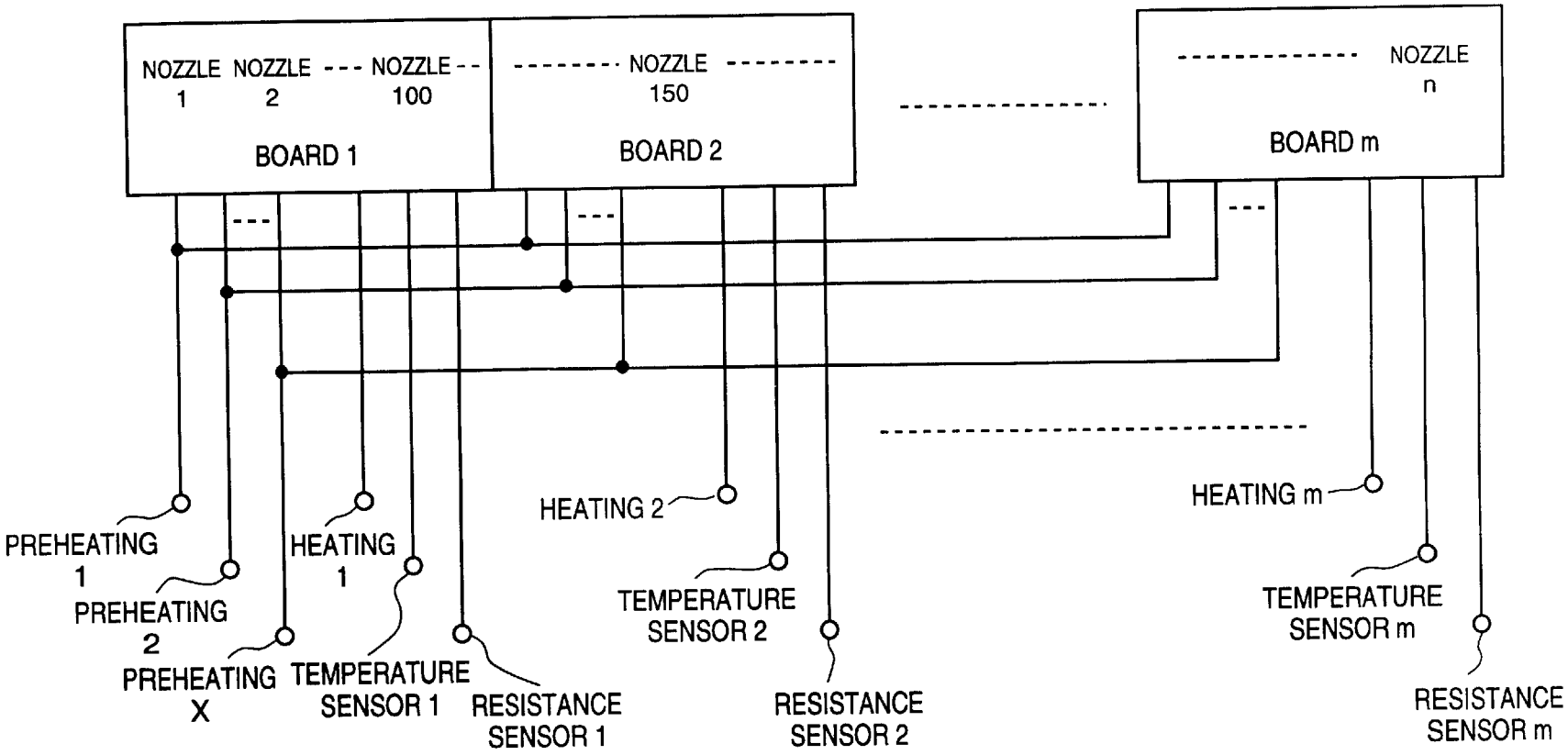
FIG. 12 is a block diagram showing a multiple-nozzle head constituted by an array of a plurality of heater boards.

Reference will be had to FIG. 12 to describe the construction of a multiple-nozzle head constituted by a plurality of the heater boards 1000 arranged in a row. There are m-number of boards in the row and a total of n-number of nozzles. The description will focus on nozzles 1, 100 of board 1 and nozzle 150 of board 2.

Figure 13:
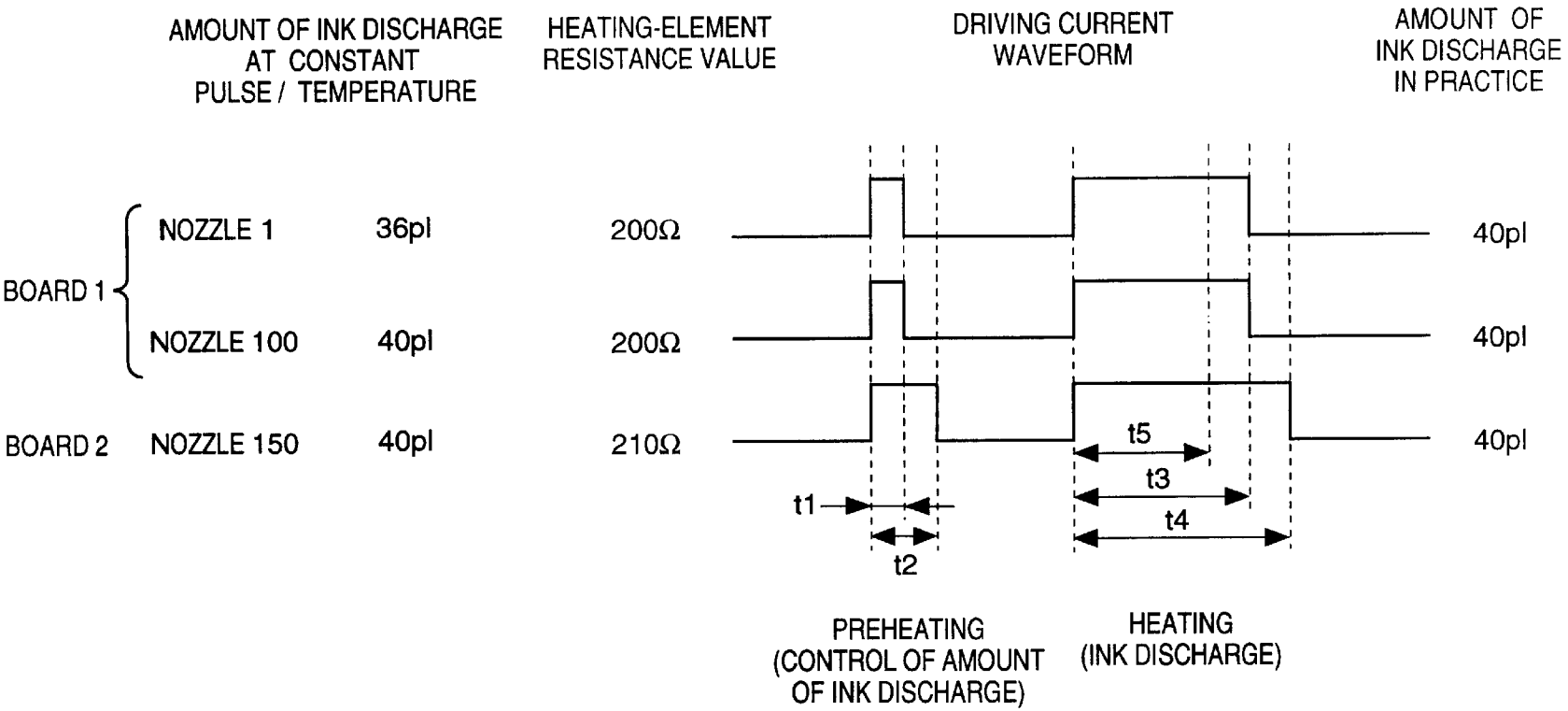
FIG. 13 is a diagram showing an example of control of driving current waveforms for driving the printing elements.

As shown in FIG. 13, assume that the amounts of ink discharged by nozzles 1, 100 and 150 are 36 pl, 40 pl and 40 pl, respectively, at application of a constant pulse width at a constant temperature. In such case, selection data having a level such that the amount of ink discharged will be greater for nozzle 1 than for nozzles 100, 150 is set in the selection-data saving latch. Since it is known from resistance sensors 1, 2 that 200 Ω is the heating-resistance value of board 1 and that 210 Ω is the heating-resistance value of board 2, as shown in FIG. 13, the pulse width applied to board 2 is made larger than that applied to board 1 so that the introduced power will be rendered uniform. FIG. 13 illustrates driving current waveforms applied under these conditions. It will be understood that the preheating pulse of nozzle 1 which discharges a small amount of ink has a pulse width larger than that of the preheating pulses for nozzles 100 and 150 ($t1<t2$). Further, the heating pulse width t4 is larger than t3 ($t4>t3$). In FIG. 13, t5 represents the pulse width for minimum power needed to foam the ink and cause the ink droplets to be discharged from the nozzles. The following relationships hold: $t1$, $t2<t5$ and $t3$, $t4>t5$.

Thus, the preheating pulses are changed under conditions in which the relations $t1<t2$; $t1$, $t2<t5$ hold with respect to a change in the temperature of the board during drive. As a result, the amount of ink discharged from each nozzle during actual drive can be made 40 pl at all times. This makes it possible to achieve high-quality printing without unevenness and blurring. Furthermore, with regard to the heating pulses exhibiting a high power, the pulse width is adjusted in dependence upon the resistance value of the board, whereby a constant power is applied without waste. This contributes to a longer service life for the printhead.

Figure 14:
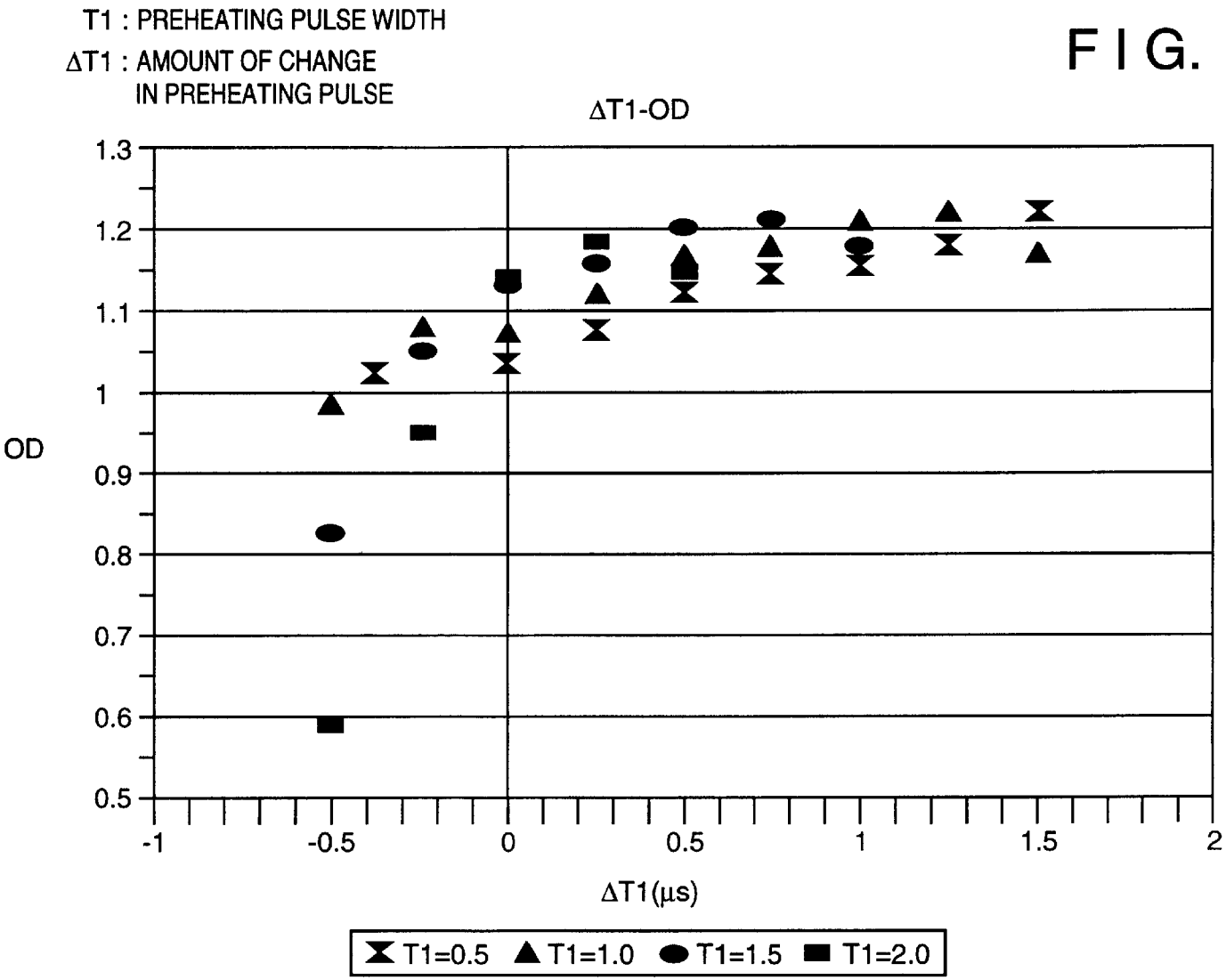
FIG. 14 is a diagram showing the relationship between an OD value and preheating pulses.

FIG. 14 illustrates a change in OD value in a case where the preheating pulses are changed.

Figure 15:
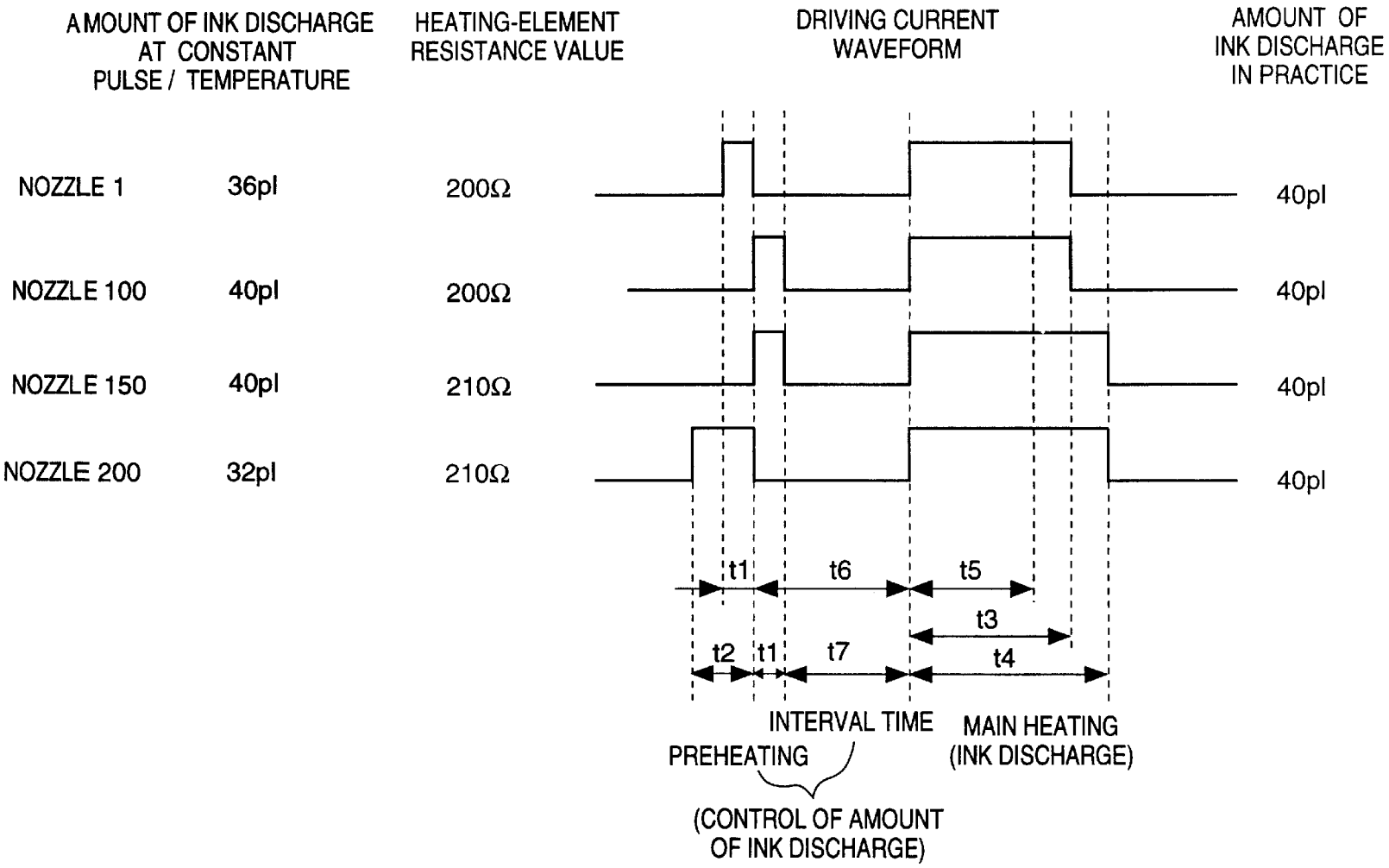
FIG. 15 is a diagram showing driving current waveforms for driving the printing elements of this embodiment.

In a case where there is a very large density unevenness between nozzles (e.g., a case where the amount of ink discharge of nozzle 200 at a constant pulse width and temperature is 32 pl, which is 20% less than the amount of ink discharge of nozzles 100 and 150, as shown in FIG. 15), the preheating pulses fluctuate by more than 0.5 μsec from the usual value, depending upon the particular case, owing to the correction. For example, if a drive pulse which is equivalent to a single heating pulse is on the order of 4 μsec, a pulse which is approximately 15% longer than usual is applied to a printing element discharging ink which represents a low density. This has the effect of shortening the service life of the printhead. Further, when the change in a heating pulse is large, the change in the OD value also becomes very large, as shown in FIG. 14.

Figure 16:
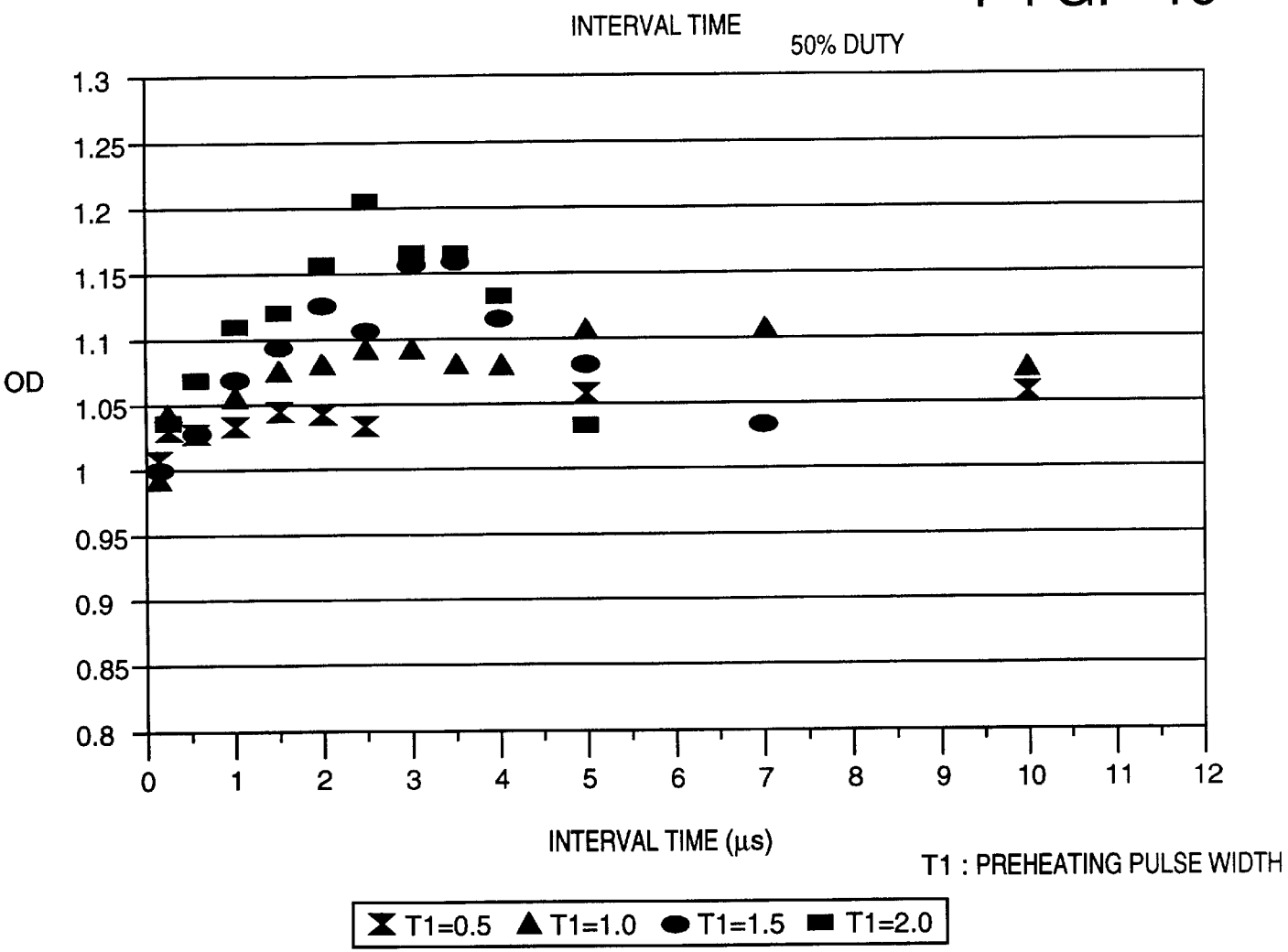
FIG. 16 is a diagram showing the relationship between an OD value and interval time.

Accordingly, in this embodiment, an interval (referred to as a quiescent interval) in which heating pulses are not applied is provided between preheating and main heating of the printhead, as shown in FIG. 15, thereby changing the printing density. As a result, there is no shortening in the life of the printhead. FIG. 16 illustrates a change in the OD value in a case where the preheating pulse width and main heating pulse width are fixed and the quiescent interval is changed.

As a result, if emphasis is placed upon a change in the quiescent interval and a printed dot which cannot be corrected within the range of this change is corrected utilizing the preheating pulses as well, then a large change in energy need not be applied to the printing elements of the printhead, the life of the printhead can be extended and the quality of a printing image can be improved.

In this embodiment, the application of drive pulses differs from that shown in FIG. 13 with regard particularly to nozzle 1 and nozzle 200, as shown in FIG. 15. With regard to nozzle 1, density is somewhat lower in comparison with nozzles 100 and 150 (the amount of reduction in ink discharge is 10%). Therefore, the quiescent interval is made slightly longer (t6) in comparison with that (t7) for nozzles 100 and 150. On the other hand, with regard to nozzle 200, there is a very large difference in density in comparison with nozzles 100 and 150 (the amount of reduction in ink discharge is 20%). Therefore, while the interval time is lengthened (t6), the preheating pulse width is stretched (t2) in comparison with the heating pulse width (t1) of nozzles 1, 100 and 150 to correct the amount in ink discharge. If this arrangement is adopted, a correction of density unevenness can be achieved without applying a large change in energy to the printing elements of the printhead.

Thus, in accordance with the present invention, the dots of prescribed pattern data, which have been printed by a printhead, are gathered together in a prescribed plurality of areas per each nozzle (recording element) of the printhead upon taking into account the visual discriminating ability of the human eye, and information obtained from the plurality of areas can be applied as density unevenness data. As a result, a variation in dot-to-dot diameter which exceeds the visual discriminating ability of the human eye is no longer discerned as density unevenness. In comparison with a case in which the dot diameter of each dot is discerned as density unevenness, information capable of accurate density correction can be supplied more rapidly for each printing element. As a result, it is possible to perform more rapid entry of fine correction data adapted to each printing element in the final stage of the printhead manufacturing process.

Furthermore, in a case where the amount of ink per printing operation discharged from each nozzle of the printhead is adjusted using the correction data obtained, the width of the quiescent interval between a preheating pulse and a main heating pulse is adjusted along with the pulse widths of these pulses. As a result, even if the amount of ink discharge fluctuates widely between nozzles under conditions of a constant pulse width or constant temperature, control can be performed so as to equalize the amount of ink discharge from one nozzle to the next without lengthening pulse width to such an extent that the printhead will be subjected to an abnormally large load. This makes it possible to prolong the life of the printhead while attaining a high image quality.

In the description set forth above, it is mentioned that the preheating pulses are selected on the board. However, this does not impose a limitation upon the invention. For example, the density correction may be performed by changing the width of the main heating pulses using a counter or the like.

Furthermore, it goes without saying that the present invention may be applied to effect a density correction if the board is such that control of the driving power of each printing element is possible. The same density correction can be performed even if the printhead has a construction different from that described.

In the description given above, it is described that the control unit on the side of the printing apparatus controls the printing operation of the printhead on the basis of correction data that has been stored in a memory within the printhead. However, an arrangement may be adopted in which such a control unit is provided within the printhead.

Though a full-line printer has been taken as an example in the description given above, the invention is not limited to such a printer. For example, in a serial printer of the type in which printing is performed by moving a printhead mounted on a carriage, the invention is applicable to an arrangement in which the printing is carried out by a number of nozzles arrayed in a row in the direction in which the recording paper is conveyed. Also, this invention is applicable to another type of printhead such as an ink jet printhead, thermal printhead or LED printhead.

It goes without saying that equivalent effects are obtained even if there is a difference in the method of setting the driving power of each of the recording elements of the printhead.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for correcting a printing characteristic of a printhead having a plurality of printing elements and memory means for storing data, comprising:

printhead drive means for driving the printhead to perform experimental printing on a recording medium;

detecting means for detecting a variation in density per a predetermined area of an image that has been printed on the recording medium, wherein the predetermined area is defined by N pixels in a first direction in which the plurality of printing elements are arrayed and M pixels in a second direction different from the first direction;

correction-data generating means for generating, per the plurality of printing elements, correction data for correcting the variation in density detected by said detecting means; and writing means for writing the correction data in said memory means of the printhead, wherein N is a positive integer greater than 1 and less than 9, M is a positive integer greater than 15 and less than 1025, dots are formed in the predetermined area by sampling pixels, and a resolution per N pixels is less than 300 dpi.

2. The apparatus according to claim 1, further comprising control means for performing control so as to repeat experimental printing, by said printhead drive means, which reflects the correction data, detection of the variation in density by said detecting means and generation of the correction data by said correction-data generating means, until the variation in density is made uniform.

3. The apparatus according to claim 2, wherein the writing of the correction data by said writing means is performed after the variation in density has been made uniform by repetitive control exercised by said control means.

4. The apparatus according to claim 1, further comprising conveyance means for conveying the recording medium in a predetermined direction.

5. The apparatus according to claim 1, further comprising preliminary discharge means for causing the printhead to discharge printing material preliminarily in order to stabilize the printing operation of the printhead before the experimental printing is performed by the printhead.

6. The apparatus according to claim 1, wherein said printhead drive means generates a prescribed printing pattern that is printed on the recording medium.

7. The apparatus according to claim 1, wherein said detecting means includes:

reading means for reading the printed image;

image processing means for processing an image signal representing the image read by said reading means;

counting means for counting the number of black pixels or white pixels per the plurality of pixels from the image signal that has been subjected to image processing; and binarizing means for comparing the number of black pixels or white pixels obtained by said counting means with a predetermined threshold value, and binarizing the number of black pixels or white pixels, wherein said correction-data generating means generates the correction data based upon the binarized value.

8. The apparatus according to claim 7, wherein said reading means includes a CCD camera.

9. The apparatus according to claim 1, wherein said detecting means has counting means for counting the number of black pixels or white pixels per the plurality of pixels, and said correction-data generating means generates the correction data based upon the number of black pixels or white pixels counted.

10. The apparatus according to claim 1, wherein dots having a 50% duty are formed in the predetermined area of the image.

11. The apparatus according to claim 1, wherein the plurality of printing elements are arrayed at a resolution of 360 dpi, N is equal to 4, and M is equal to 32.

12. A printhead corrected by a method of correcting a printing characteristic of said printhead, said printhead having a plurality of printing elements and a memory unit for storing data, said method comprising:

a testing step of performing experimental printing on a recording medium using the printhead;

a detecting step of detecting a variation in density per a predetermined area of an image that has been printed on the recording medium, wherein the predetermined area is defined by N pixels in a first direction in which the plurality of printing elements are arrayed and M pixels in a second direction different from the first direction;

a correction-data generating step of generating, per the plurality of printing elements, correction data for correcting the variation in density detected in said detecting step; and a writing step of writing the correction data in the memory unit of the printhead, wherein N is a positive integer greater than 1 and less than 9, M is a positive integer greater than 15 and less than 1025, dots are formed in the predetermined area by sampling pixels, and a resolution per N pixels is less than 300 dpi.

13. The printhead according to claim 12, further comprising:

input means for externally entering printing data; and drive means for driving the plurality of printing elements based upon the printing data entered by said input means.

14. The printhead according to claim 12, wherein an EEPROM is included as said memory unit.

15. The printhead according to claim 12, wherein the plurality of printing elements is n in number, and circuit boards having m-number of printing elements are arrayed in a line, the number of said circuit boards being n/m.

16. The printhead according to claim 12, wherein said printhead is an ink-jet printhead which performs printing by discharging ink.

17. The printhead according to claim 12, wherein said printhead discharges ink by utilizing thermal energy, said printhead having a thermal energy transducer for generating thermal energy applied to the ink.

18. A printing apparatus using a printhead corrected by a method of correcting a printing characteristic of said printhead, said printhead having a plurality of printing elements and a memory unit for storing data, said method comprising a testing step of performing experimental printing on a recording medium using the printhead, a detecting step of detecting a variation in density per a predetermined area of an image that has been printed on the recording medium, wherein the predetermined area is defined by N pixels in a first direction in which the plurality of printing elements are arrayed and M pixels in a second direction different from the first direction, a correction-data generating step of generating, per the plurality of printing elements, correction data for correcting the variation in density detected in said detecting step, and a writing step of writing the correction data in the memory unit of the printhead, said apparatus comprising:

receiving means for receiving the correction data from the printhead;

generating means which, on the basis of the correction data, generates a control signal for controlling operation of drive means in such a manner that the plurality of printing elements form uniform pixels; and transmitting means for transmitting the control signal to the printhead, wherein N is a positive integer greater than 1 and less than 9, M is a positive integer greater than 15 and less than 1025, dots are formed in the predetermined area by sampling pixels, and a resolution per N pixels is less than 300 dpi.

19. The apparatus according to claim 18, wherein said printhead is an ink-jet printhead which performs printing by discharging ink.

20. The apparatus according to claim 18, wherein said printhead discharges ink by utilizing thermal energy, said printhead having a thermal energy transducer for generating thermal energy applied to the ink.

21. The apparatus according to claim 18, wherein the control signal includes a first pulse signal and a second pulse signal that follows the first pulse signal, and said generating means adjusts the width of the first pulse signal, the width of the second pulse signal and the pulse interval between the first and second pulse signals.

22. The apparatus according to claim 21, wherein the pulse interval between the first and second pulses is adjusted in a case where the variation in density printed by the plurality of printing elements is small, and the width of the first pulse signal is adjusted in a case where the variation in density printed by the plurality of printing elements is large.

23. A method of correcting a printing characteristic of a printhead having a plurality of printing elements and a memory unit for storing data, said method comprising:

a testing step of performing experimental printing on a recording medium using the printhead;

a detecting step of detecting a variation in density per a predetermined area of an image that has been printed on the recording medium, wherein the predetermined area is defined by N pixels in a first direction in which the plurality of printing elements are arrayed and M pixels in a second direction different from the first direction;

a correction-data generating step of generating, per the plurality of printing elements, correction data for correcting the variation in density detected in said detecting step; and a writing step of writing the correction data in the memory unit of the printhead, wherein N is a positive integer greater than 1 and less than 9, M is a positive integer greater than 15 and less than 1025, dots are formed in the predetermined area by sampling pixels, and a resolution per N pixels is less than 300 dpi.

24. The method according to claim 23, further comprising a control step of performing control so as to repeat experimental printing, in said testing step, which reflects the correction data, detection of the variation in density in said detecting step and generation of the correction data in said correction-data generating step, until the variation in density is made uniform.

25. The method according to claim 24, wherein the writing of the correction data at said writing step is performed after the variation in density has been uniformalized by repetitive control exercised in said control step.

26. The method according to 23, further comprising a preliminary discharge step of causing the printhead to discharge printing material preliminarily in order to stabilize the printing operation of the printhead before the experimental printing is performed by the printhead.

27. The method according to claim 23, wherein said detecting step includes:

a reading step of reading the printed image;

an image processing step of processing an image signal representing the read image in said reading step;

a counting step of counting the number of black pixels or white pixels per the plurality of pixels from the image signal that has been subjected to said image processing step; and a binarizing step of comparing the number of black pixels or white pixels obtained in said counting step with a predetermined threshold value, and binarizing the number of the black pixels or white pixels, and wherein the correction data is generated, based on the binarized value in said correction-data generating step.

28. The method according to claim 23, wherein said detecting step has a counting step of counting the number of black pixels or white pixels per the plurality of pixels, and the correction data is generated based on the counted number of black pixels or white pixels in said correction-data generating step.

29. A method according to claim 23, wherein dots having a 50% duty are formed in the predetermined area of the image.

30. The method according to claim 23, wherein the plurality of printing elements are arrayed at a resolution of 360 dpi, N is equal to 4, and M is equal to 32.

* * * * *

UNITED STATES PATENT AND TRADEMARK OFFICE

CERTIFICATE OF CORRECTION

PATENT NO. : 6,042,213
DATED : March 28, 2000
INVENTOR(S) : Hayaski

It is certified that error appears in the above-identified patent and that said Letters Patent is hereby corrected as shown below:

Item [56] References Cited:
U.S. PATENT DOCUMENTS, ",510,369" should read -- 5,610,639 --.

FOREIGN PATENT DOCUMENTS,
"2002009" should read -- 2-2009 --;
"4232749" should read -- 4232749 --
"7242004" should read -- 7-242004 --.
"4229278" should read -- 4-229278 --;
"5024192" should read -- 5-24192 --;

The following should be inserted;
-- OTHER PUBLICATIONS
Shoten, "Optical Engineering Handbook," pp. 742-747 --.

Column 7,
Line 2, "uniform" should read -- a uniform --.

Column 8,
Line 27, "32 dots = 32 dots" should read --32 dots x 32 dots --.

Column 9,
Line 44, "then should read -- the --.

Column 13,
Line 42, "in" should read -- of --.

Column 20,
Line 1, "uniformalized" should read -- made uniform --.

Signed and Sealed this

Twenty-first Day of August, 2001

*Attest:*

*Attesting Officer*

NICHOLAS P. GODICI
*Acting Director of the United States Patent and Trademark Office*